US011906208B2

(12) United States Patent
Kim et al.

(10) Patent No.: US 11,906,208 B2
(45) Date of Patent: Feb. 20, 2024

(54) HYBRID MULTI-AIR CONDITIONING SYSTEM

(71) Applicant: LG ELECTRONICS INC., Seoul (KR)

(72) Inventors: Yejin Kim, Seoul (KR); Jihyeong Ryu, Seoul (KR); Eunjun Cho, Seoul (KR); Pilhyun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 17/531,307

(22) Filed: Nov. 19, 2021

(65) Prior Publication Data

US 2022/0163241 A1 May 26, 2022

(30) Foreign Application Priority Data

Nov. 26, 2020 (KR) ..... 10-2020-0161469

(51) Int. Cl.
*F25B 13/00* (2006.01)
*F24D 3/18* (2006.01)

(52) U.S. Cl.
CPC ..... *F25B 13/00* (2013.01); *F24D 3/18* (2013.01); *F25B 2313/003* (2013.01);
(Continued)

(58) Field of Classification Search
CPC ..... F25B 13/00; F25B 2313/003; F25B 2313/0231; F25B 2313/0233;
(Continued)

(56) References Cited

U.S. PATENT DOCUMENTS

| | | | |
|---|---|---|---|
| 9,797,605 | B2 | 10/2017 | Tamaki et al. |
| 2011/0072839 | A1 | 3/2011 | Itagaki et al. |
| 2015/0330675 | A1 | 11/2015 | Tamaki et al. |

FOREIGN PATENT DOCUMENTS

| | | |
|---|---|---|
| AU | 2005232242 | 11/2006 |
| CN | 102393046 | 3/2012 |

(Continued)

OTHER PUBLICATIONS

Korean Office Action issued in Application No. Oct. 2020-0161469 dated Dec. 22, 2021.

(Continued)

*Primary Examiner* — Kun Kai Ma
(74) *Attorney, Agent, or Firm* — KED & ASSOCIATES

(57) ABSTRACT

A hybrid multi-air conditioning system with no receiver is provided for optimal valve control. The hybrid multi-air conditioning system includes: a hot-water unit for exchanging heat between refrigerant and water; at least one indoor unit installed indoors and comprising an indoor heat exchanger and an indoor unit expansion valve; and an outdoor unit connected to the indoor unit and the hot-water unit via a refrigerant pipeline and comprising an outdoor heat exchanger, a compressor, and an outdoor unit expansion valve, wherein, when an abnormal refrigerant enters either the at least one indoor unit or the outdoor unit according to an operation mode, the abnormal refrigerant is shut off from the hot-water unit and the at least one indoor unit or the outdoor unit which operates as a condenser. Accordingly, the hybrid multi-air conditioning system improves heat exchange efficiency via direct heat transfer between refrigerant and water by having a coil wound on the water tank to transfer heat between refrigerant and water.

18 Claims, 17 Drawing Sheets

(52) U.S. Cl.
CPC ..... *F25B 2313/0231* (2013.01); *F25B 2313/0233* (2013.01); *F25B 2313/02741* (2013.01); *F25B 2313/0314* (2013.01)

(58) Field of Classification Search
CPC ..... F25B 2313/0314; F25B 2600/19; F25B 49/02; F25B 41/31; F25B 2339/047; F25B 2600/2513; F25B 29/003; F25B 6/02; F24D 17/02; F24D 3/18; F24F 1/0003; F24F 5/0096
See application file for complete search history.

(56) References Cited

FOREIGN PATENT DOCUMENTS

| | | | |
|---|---|---|---|
| CN | 103134231 | | 6/2013 |
| CN | 105264297 | | 1/2016 |
| CN | 106524346 A | * | 3/2017 |
| EP | 2557377 | | 2/2013 |
| JP | H7-151420 | | 6/1995 |
| JP | 2000-111181 | | 4/2000 |
| JP | 2014-016067 | | 1/2014 |
| JP | 2018-013257 | | 1/2018 |
| KR | 20-0297124 | | 12/2002 |
| KR | 10-0702907 | | 4/2007 |
| KR | 10-2010-0023877 | | 3/2010 |
| KR | 20190081837 A | * | 7/2019 |
| WO | WO 2014/106895 | | 7/2014 |
| WO | WO 2014/188575 | | 11/2014 |
| WO | WO 2019/064332 | | 4/2019 |

OTHER PUBLICATIONS

Japanese Office Action dated Oct. 4, 2022 issued in Application No. 2021-190736.
Korean Notice of Allowance dated Oct. 20, 2022 issued in Application No. 10-2020-0161469.
European Search Report dated May 2, 2022 issued in Application No. 21209750.5.
Chinese Office Action dated May 15, 2023 issued in Application No. 202111393839.2.

* cited by examiner

HYBRID MULTI-AIR CONDITIONING SYSTEM

CROSS-REFERENCE TO RELATED PATENT APPLICATIONS

This application claims priority to Korean Patent Application No. 10-2020-0161469, filed Nov. 26, 2020, whose entire disclosures are hereby incorporated by reference.

BACKGROUND OF THE DISCLOSURE

Field of the Disclosure

The present disclosure relates to a hybrid multi-air conditioning system, and more particularly, to a hybrid multi-air conditioning system including a coil-type water tank heat exchanger and a method for controlling the same.

Related Art

In general, a hybrid system capable of simultaneous operation of cooling and hot-water heating employs a plate-type heat exchanger such as Hydro Kit for use on a water tank, by which refrigerant-to-water heat transfer with an air cycle takes place first and then water-to-water heat transfer takes place between Hydro Kit and the water tank.

Hot-water heating systems using Hydro Kit are used a lot in areas with legal restrictions on direct heat transfer between water used by people and refrigerant. These systems have drawbacks such as higher material costs, a larger installation area, and a decline in heat exchange efficiency due to the secondary heat transfer, as compared to a method in which refrigerant-to-water heat transfer takes place directly in the water tank.

As a conventional technology, Korean Laid-Open Patent No. 10-2010-0023877 discloses a heat pump-type hot-water heating apparatus, which includes a heat source heat pump unit having a heat-dissipating heat exchanger that dissipates heat from refrigerant by condensing the refrigerant. Also, the hot-water heating apparatus includes a water tank storing water, a water supply pipeline for supplying water from the outside into the water tank, a water circulation pipeline communicating with the bottom and top of the water tank, for allowing the water at the bottom of the water tank to circulate to the top of the water tank through a bypass, a heat-absorbing heat exchanger located midway in the water circulation pipeline so as to absorb heat from the heat-dissipating heat exchanger of the heat source heat pump unit, and a hot-water unit comprised of a hot-water pipeline that heats warm water at the top of the water tank.

Moreover, in a conventional technology, when a Hydro Kit is used, a refrigerant turns into a high-pressure vapor by running a compressor in a cooling and hot-water heating operation, and part of the refrigerant passes through a four-way valve and is sent to an outdoor unit, and the rest of the refrigerant passes through a water tank solenoid valve and is sent to the Hydro Kit. The high-pressure refrigerant sent to the outdoor unit (condenser) condenses to liquid by exchanging heat with outside air and then passes through an expansion valve and is sent to an indoor unit.

Meanwhile, the refrigerant sent to the Hydro Kit is condensed by exchanging heat with low-temperature water in the water tank, then passes through the expansion valve, and then combines with the refrigerant coming from the outdoor unit. In this case, the flow of water drawn into the Hydro Kit is regulated by a water pump to adjust the amount of heat transfer. The refrigerants condensed in the Hydro Kit and the outdoor unit combine in an indoor unit valve and then pass through it to enter the indoor unit as a low-pressure refrigerant and return to the compressor via heat exchange with inside air.

By using the Hydro Kit as in the conventional technology, the amount of heat of condensation of refrigerant may be adjusted by regulating the flow of water. However, if a condensing heat exchanger for the refrigerant is wound directly on the water tank, the amount of heat of condensation varies with the water temperature in the water tank and the amount of water used by the user and therefore the point of control of the water tank condenser also varies.

This means that the appropriate amount of refrigerant charge and the degree of subcooling vary with the outdoor temperature/indoor temperature of a typical air conditioner. Since an overcharge of refrigerant or a lack of refrigerant may be prevented by attaching a receiver to the condenser, changing the amount of refrigerant charge may make it easier to control the degree of subcooling.

Moreover, by installing a receiver to the condenser, only a low-pressure liquid refrigerant will be sent to an evaporator, thereby preventing a sharp pressure drop at an expansion valve of the indoor unit in cooling operation.

In the case of a hybrid system capable of simultaneous operation of cooling and hot-water heating, the heat exchangers at the water tank and outdoor unit operate as two condensers, respective expansion valves are installed at a water tank outlet and an indoor unit outlet, and refrigerant is sent to the expansion valve of the indoor unit. Refrigerants discharged from the respective condensers need to pass through the two expansion valves until they change from high pressure to low pressure. If the opening degrees of the expansion valves are too small, excessive pressure loss occurs and abnormal refrigerant enters the expansion valves.

If abnormal refrigerant enters the expansion valves, the evaporation temperature of the evaporator may drop significantly, and the drop in evaporation temperature may involve the risk of cycle hunting and entry into limited control.

In addition, if the receiver is installed to prevent this, refrigerant accumulates in the receiver even though the abnormal refrigerant is discharged from the expansion valves of the condensers, and therefore only the liquid refrigerant is sent to the evaporator, which may prevent a sharp drop in evaporation temperature. However, the addition of the receiver occupies space and will increase material cost and installation cost.

PRIOR ART DOCUMENT

Patent Document

Korean Laid-Open Patent No. 10-2010-0023877 (Published on Mar. 4, 2010)

SUMMARY OF THE DISCLOSURE

As explained above, a problem with a hybrid multi-air conditioning system capable of simultaneous operation of hot-water heating and cooling is that the use of a Hydro Kit decreases heat exchange efficiency due to multi-stage heat exchange. To address this problem, a first aspect of the present disclosure is to provide a hybrid multi-air conditioning system in which refrigerant-to-water heat transfer initially takes place directly in a water tank.

A second aspect of the present disclosure is to provide a hybrid multi-air conditioning system that prevents entry of abnormal refrigerant by controlling the optimal degree of undercooling by regulating the opening degrees of a hot-water expansion valve and an outdoor unit expansion valve, without installation of a receiver.

Particularly, a third aspect of the present disclosure is to provide a hybrid multi-air conditioning system that allows for valve control so as to prevent entry of abnormal refrigerant by installing several temperature sensors at front and rear ends of the expansion valves and controlling the maximum degree of subcooling by periodically reading current temperatures.

In addition to a hybrid multi-air conditioning system capable of simultaneous operation of hot-water heating and cooling, a fourth aspect of the present disclosure is to provide a method for controlling each expansion valve so as to enable hot-water heating and space heating, as well as simultaneous operation of hot-water heating and cooling.

An exemplary embodiment of the present disclosure provides a hybrid multi-air conditioning system for ensuring optimal valve control without a receiver, the hybrid multi-air conditioning system comprising: a hot-water unit for exchanging heat between refrigerant and water; at least one indoor unit installed indoors and comprising an indoor heat exchanger and an indoor unit expansion valve; and an outdoor unit connected to the indoor unit and the hot-water unit via a refrigerant pipeline and comprising an outdoor heat exchanger, a compressor, and an outdoor unit expansion valve, wherein, when either the at least one indoor unit or the outdoor unit is operated as an evaporator according to an operation mode and an abnormal refrigerant enters the evaporator, the abnormal refrigerant is shut off from the hot-water unit and the at least one indoor unit or the outdoor unit which operates as a condenser.

The hot-water unit may comprise: a water tank storing the water; a hot-water heat exchanger wound on an outer wall of the water tank, for transferring heat between the refrigerant and the water while allowing the refrigerant to flow inside; and a hot-water expansion valve for shutting off the refrigerant condensed by the hot-water heat exchanger or allowing the same to flow therethrough, It may be determined whether the abnormal refrigerant is discharged from the hot-water unit based on front and rear end temperatures of the refrigerant passing through the hot-water expansion valve.

The hot-water unit may comprise: a first temperature sensor installed at a front end of the hot-water expansion valve; and a second temperature sensor installed at a rear end of the hot-water expansion valve, wherein it is determined whether the abnormal refrigerant is discharged or not based on a temperature difference between the first temperature sensor and the second temperature sensor.

The hybrid multi-air conditioning system according to this embodiment of the present disclosure may determine whether an abnormal refrigerant is discharged or not by controlling the temperature sensors.

Specifically, the outdoor unit may comprise: a third temperature sensor installed at a front end of the outdoor unit expansion valve; and a fourth temperature sensor installed at a rear end of the outdoor unit expansion valve, wherein, when the outdoor unit is operated as a condenser, it may be determined whether the abnormal refrigerant is discharged or not based on a temperature difference between the third temperature sensor and the fourth temperature sensor.

The indoor unit may further comprise a fifth temperature sensor at a discharge side of the indoor heat exchanger, wherein, when the outdoor unit is operated as a condenser, it may be determined whether the abnormal refrigerant is discharged from the outdoor unit by comparing current and previous temperatures from the fifth temperature sensor.

If the abnormal refrigerant is not discharged from the hot-water unit and a difference between the current and previous temperatures from the fifth temperature sensor is greater than a threshold, it may be determined that the abnormal refrigerant is discharged from the outdoor unit.

The hot-water expansion valve may be fully opened if the abnormal refrigerant is discharged from the hot-water unit, and the outdoor unit expansion valve may be fully opened if the abnormal refrigerant is discharged from the outdoor unit.

The outdoor unit may further comprise: a hot-water valve that allows a condensed refrigerant to flow from the compressor to the hot-water unit; and an outdoor unit valve that allows the condensed refrigerant to pass through a four-way valve from the compressor and flow to the outdoor heat exchanger or the indoor heat exchanger.

The water temperature in the water tank and the temperature of the condenser may be compared before regular operation to uniformly distribute a liquid refrigerant.

If the water temperature is higher than the temperature of the condenser, the hot-water expansion valve may be fully opened to uniformly distribute the liquid refrigerant concentrated in the hot-water unit.

If the water temperature is lower than the temperature of the condenser, the indoor unit expansion valve or outdoor unit expansion valve of the condenser may be fully opened to uniformly distribute the liquid refrigerant concentrated in the condenser.

When the liquid refrigerant is uniformly distributed, the hot-water valve and the outdoor unit valve may be opened.

If the temperature difference between the first temperature sensor and the second temperature sensor is greater than a first threshold, it may be determined that the abnormal refrigerant is discharged from the hot-water unit.

If the temperature difference between the third temperature sensor and the fourth temperature sensor is greater than a second threshold, it may be determined that the abnormal refrigerant is discharged from the outdoor unit.

The first threshold may be equal to the second threshold.

The hybrid multi-air conditioning system may be operated in a hot-water heating and cooling operation mode, a hot-water heating and space heating operation mode, a cooling-only operation mode, a space heating-only operation mode, and a hot-water heating-only operation mode.

When the hybrid multi-air conditioning system is in the hot-water heating and space heating operation mode, the outdoor unit may operate as an evaporator, the indoor unit may operate as a condenser, and it may be determined that the abnormal refrigerant enters the outdoor unit.

The hybrid multi-air conditioning system may allow the condensed refrigerant from the hot-water expansion valve to directly enter the indoor unit or the outdoor unit which operates as the evaporator.

The hot-water heat exchanger may be formed as a pipeline wound on an outer wall of the water tank in coil form that allows the refrigerant to flow therethrough.

DESCRIPTION OF EXEMPLARY EMBODIMENTS

Figure 1:
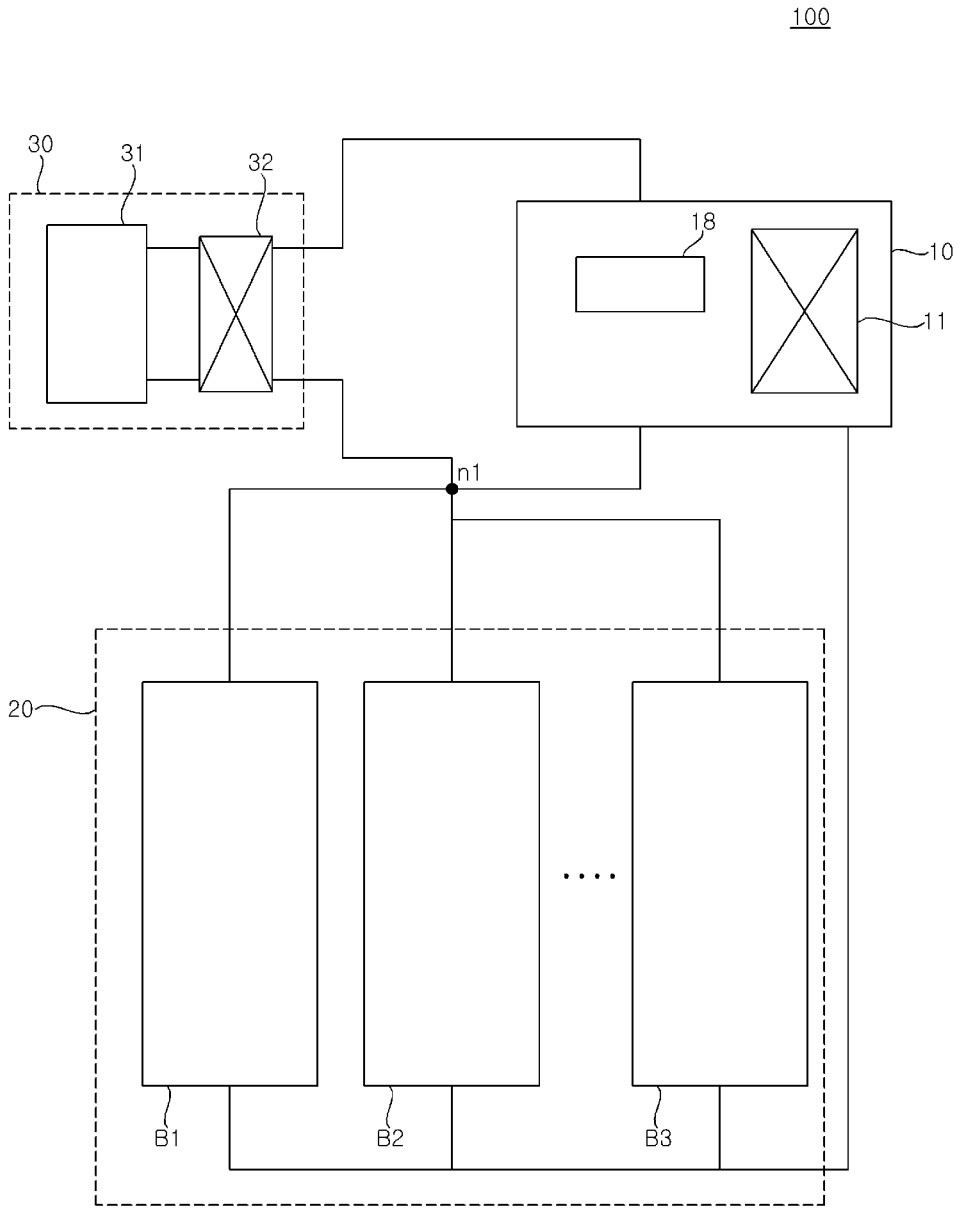
FIG. 1 is a schematic block diagram of a hybrid multi-air conditioning system according to one embodiment of the present disclosure.

Advantages and features of the present disclosure and methods for achieving them will be made clear from the embodiments described below in detail with reference to the accompanying drawings. The present disclosure may, however, be embodied in many different forms, and should not be construed as being limited to the embodiments set forth herein. Rather, these embodiments are provided so that this disclosure will be thorough and complete, and will fully convey the scope of the present disclosure to those skilled in the art. The present disclosure is merely defined by the scope of the claims. Like reference numerals refer to like elements throughout the specification.

Spatially relative terms such as "below", "beneath", "lower", "above", or "upper" may be used herein to describe one element's relationship to another element as illustrated in the figures. It will be understood that such spatially relative terms are intended to encompass different orientations of the device in addition to the orientation depicted in the figures. For example, if a component in the figures is turned over, elements described as "below" or "beneath" other elements would then be oriented "above" the other elements. The exemplary terms "below" or "beneath" can, therefore, encompass both positional relationships of above and below. Since the component may be oriented in another direction, spatially relative terms may be interpreted in accordance with the orientation of the device.

The terminology used in the present disclosure is for the purpose of describing particular embodiments only, and is not intended to limit the disclosure. As used in the disclosure and the appended claims, the singular forms "a", "an", and "the" are intended to include the plural forms as well, unless the context clearly indicates otherwise. It will be further understood that the terms "comprises" and/or "comprising", when used in this specification, specify the presence of stated components, steps, and/or operations, but do not preclude the presence or addition of one or more other components, steps, and/or operations.

Unless otherwise defined, all terms (including technical and scientific terms) used herein have the same meanings as those commonly understood by one of ordinary skill in the art. It will be further understood that terms such as those defined in commonly used dictionaries should be interpreted as having meanings consistent with their meanings in the context of the relevant art and the present disclosure, and are not to be interpreted in an idealized or overly formal sense unless expressly so defined herein.

In the drawings, the thickness or size of each element may be exaggerated, omitted, or schematically illustrated for convenience of description and clarity. Also, the size or area of each element may not entirely reflect the actual size thereof.

Hereinafter, an exemplary embodiment of the present disclosure will be described as follows with reference to the accompanying drawings.

Figure 2:
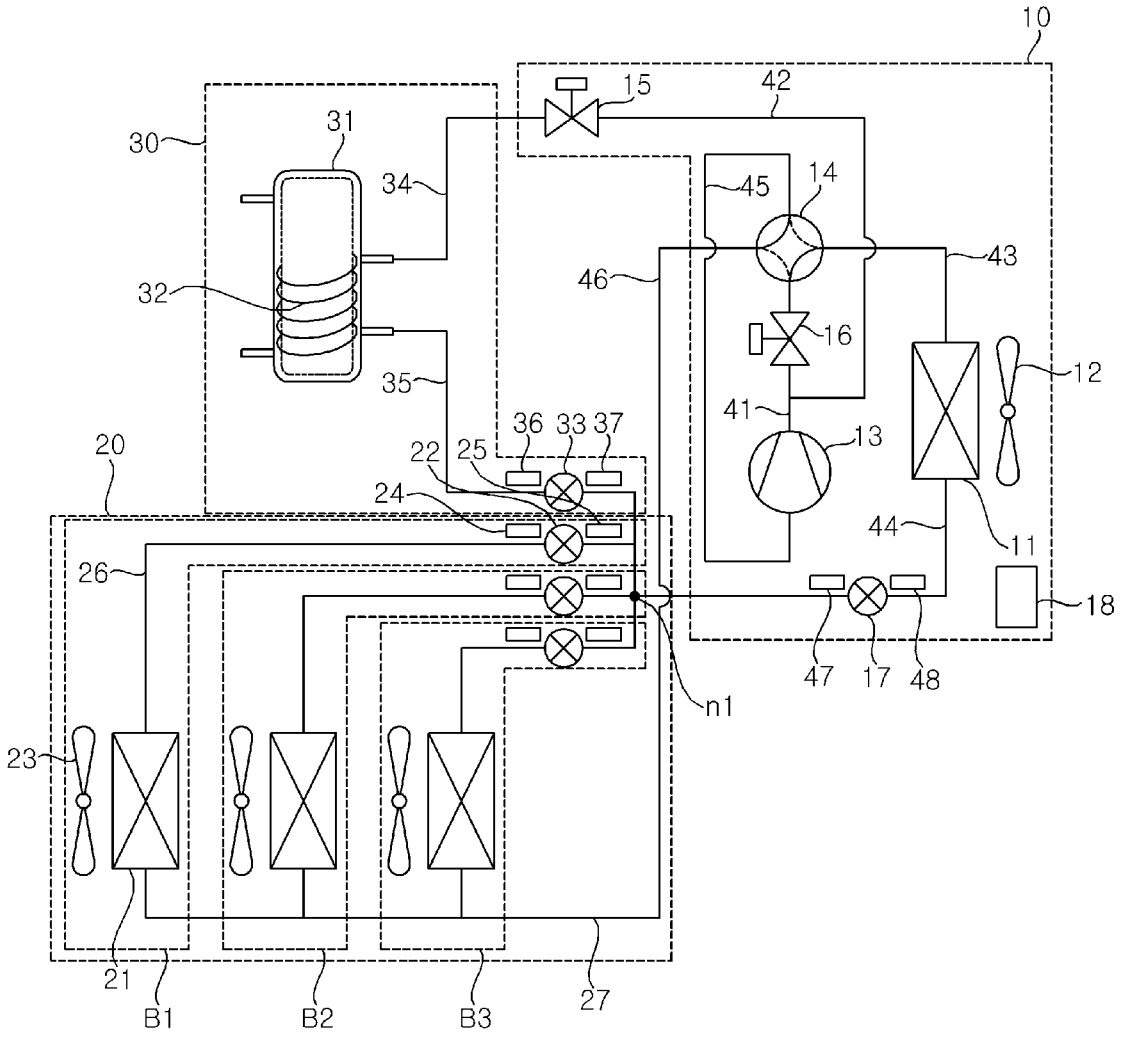
FIG. 2 is a detailed block diagram of the hybrid multi-air conditioning system of FIG. 1 according to the one embodiment of the present disclosure.

FIG. 1 is a schematic block diagram of a hybrid multi-air conditioning system according to one embodiment of the present disclosure. FIG. 2 is a detailed block diagram of the hybrid multi-air conditioning system of FIG. 1 according to one embodiment of the present disclosure.

Referring to FIGS. 1 and 2, the hybrid multi-air conditioning system 100 according to the one embodiment of the present disclosure includes a hot-water unit 30, at least one indoor unit 20 for both cooling and heating, and an outdoor unit 10 for both cooling and heating.

The hot-water unit 30 includes a long water tank (hot water tank) 31 storing water used for hot-water heating, a water circulation pipeline (not shown) that supplies water from the outside to the bottom of the water tank 31 and releases heated water to the outside, and a hot-water heat exchanger 32 attached to an outside of the water tank 31 and connected to enable heat dissipation.

In this case, heat transfer between the water tank 31 and the hot-water heat exchanger 32 occurs via heat transfer between a refrigerant flowing through the hot-water heat exchanger 32 and water inside the water tank 31, and the hot-water heat exchanger 32 operates as a condenser that performs heat dissipation.

The hot-water heat exchanger 32 may perform heat transfer by increasing the contact area in such a way that a pipeline through which refrigerant flows is wound directly on the outside of the water tank 31 in coil form. Also, the hot-water heat exchanger 32 has a hot-water inlet pipeline 34 connected to a second discharge pipeline 42 of the outdoor unit 10, and a hot-water discharge pipeline 35 that causes a condensed liquid refrigerant to flow after heat exchange with the water tank 31.

The hot-water discharge pipeline 35 may be connected to a first node n1 connecting the indoor unit 20, the outdoor unit 10, and the hot-water unit 30, and a hot-water expansion valve 33 may be disposed on the hot-water discharge pipeline 35 of the hot-water heat exchanger 32.

The hot-water expansion valve 33 provided on a discharge portion of the hot-water heat exchanger 32 may be an electronic expansion valve, and may regulate the flow of refrigerant flowing through the piping of the hot-water heat exchanger 32 and allows a condensed refrigerant to flow to the outdoor unit 10 or the indoor unit 20.

Since direct heat transfer occurs between the water in the water tank 31 and the refrigerant without a Hydro Kit, no additional parts are required, and the heat transfer does not need to be performed multiple times, thereby improving heat exchange efficiency via direct heat exchange.

Meanwhile, the outdoor unit 10 for both cooling and heating includes a compressor 13, an outdoor heat exchanger 11, an outdoor heat exchanger fan 12, and a switching unit. Here, the switching unit includes a four-way valve 14. As for the compressor 13, a plurality of compressors 13 may be connected in parallel, but are not limited to this. An accumulator (not shown) may be provided on an intake end of the compressor 13. If there are multiple compressors 13, the first compressor may be an inverter compressor capable of varying refrigerant compression capacity, and the second compressor may be a constant-speed compressor whose refrigerant compression capacity is constant.

A low-pressure connecting pipeline 46 connected to the indoor unit 20 is connected to an intake pipeline 45 of the compressor 13 via the four-way valve 14.

First and second discharge pipelines 42 and 43 are connected as high-pressure connecting pipelines to a discharge portion 41 of the compressor 13, and the first discharge pipeline 43 allows a discharged gaseous refrigerant of high temperature and high pressure to flow to the outdoor heat exchanger 11, and the second discharge pipeline 42 allows the discharged gaseous refrigerant of high temperature and high pressure to flow to the hot-water unit 30 and is connected to the hot-water heat exchanger 32.

The first discharge pipeline 43 is connected to the outdoor heat exchanger 11 via the four-way valve 14, and the second discharge pipeline 42 is connected to the hot-water heat exchange 32 such that the refrigerant discharged from the compressor 13 bypasses the four-way valve 14 without passing through it.

The outdoor heat exchanger 11 is connected to the four-way valve 14 by the first discharge pipeline 43. Refrigerant condenses or evaporates in the outdoor heat exchanger 11 via heat exchange with outside air. In this case, the outdoor unit fan 12 draws in air into the outdoor heat exchanger 11 in order to facilitate heat transfer. In the hybrid multi-air conditioning system 100 capable of cooling, space heating, and hot-water heating, the outdoor heat exchanger 11 is used as a condenser during cooling operation, and the outdoor heat exchanger 11 is used as an evaporator during space heating operation.

An outdoor unit expansion valve 17 is installed on the liquid pipe connecting pipeline 44 connecting the outdoor heat exchanger 11 and the indoor unit 20. The outdoor unit expansion valve 17 expands refrigerant during space heating operation. During space heating operation, the outdoor unit expansion valve 17 expands refrigerant condensed in a plurality of indoor heat exchangers 21 before the refrigerant enters the outdoor heat exchanger 11.

The four-way valve 14 is provided on the discharge portion 41 of the compressor 13, and switches the direction of refrigerant flowing in the outdoor unit 10. The four-way valve 14 properly switches the direction of refrigerant discharged from the compressor 13 according to the cooling, hot-water heating, or space heating operation of the hybrid multi-air conditioning system 100.

The outdoor unit 10 for both cooling and heating includes a hot-water valve 15 between the second discharge pipeline 42 and the hot-water inlet pipeline 34 and an outdoor unit valve 16 between the first discharge pipeline 43 and the discharge portion 41 of the compressor 13.

The hot-water valve 15 and the outdoor unit valve 16 may be a solenoid valve that is selectively operated as required and shuts off refrigerant or allows it to flow.

When the hot-water valve 15 and the outdoor unit valve 16 are in a cooling and hot-water heating operation or in a space heating and hot-water heating operation, if a water temperature desired by the user is reached, hot-water heating is not required, and therefore the hot-water valve 15 is closed. Thus, only the outdoor unit 10 serves as a condenser during cooling operation, and only the indoor unit 20 serves as a condenser during space heating operation.

Meanwhile, the outdoor unit 10 may further include a subcooler (not shown) on the liquid pipe connecting pipeline 44, and the subcooler may cool the refrigerant transferred to the indoor unit 20 during cooling operation.

Meanwhile, the hybrid multi-air conditioning system 100 may include at least one indoor unit 20.

A plurality of indoor units 20 for both cooling and heating may be connected to one outdoor unit 10, and FIGS. 1 and 2 illustrate three indoor units B1, B2, and B3 but are not limited to this.

Each indoor unit B1, B2, and B3 for both cooling and heating includes an indoor heat exchanger 21, an indoor unit expansion valve 22, and an outdoor unit fan 23. The three indoor units B1, B2, and B3 installed as shown in FIG. 2 include first, second, and third indoor heat exchangers 21, first, second, and third indoor heat exchangers 22, and first, second, and third indoor unit fans 23, respectively. The first, second, and third indoor heat exchangers 22 are installed on first, second, and third indoor connecting pipelines 26 connecting the first, second, and third indoor heat exchangers 21 and the first node n1. The first, second, and third indoor connecting pipelines 26 are connected to the liquid pipe connecting pipeline 44 of the outdoor unit 10 at the first node n1.

Also, the first, second, and third indoor units B1, B2, and B3 for both cooling and heating have a low-pressure connecting pipeline 46 to allow a discharged refrigerant to flow to the compressor 13.

The air conditioning system 100 according to this embodiment may further include a pressure sensor for measuring refrigerant pressure, a temperature for measuring refrigerant temperature, and a strainer for removing debris present in refrigerant flowing through a refrigerant pipe.

In the hybrid multi-air conditioning system 100 of the present disclosure, when the outdoor unit 10, the indoor unit 20, and the hot-water unit 30 act as a condenser or an evaporator according to an operation mode, refrigerant flow control may be performed by controlling the opening degrees of the currently installed electronic expansion valves, without employing a refrigerant flow control device. In particular, the electronic expansion valves may be controlled by checking the degree of superheating or the degree of subcooling by means of a plurality of temperature sensors 36, 37, 24, 25, 47, and 48 provided on the electronic expansion valves, thereby enabling optimal refrigerant flow control.

Specifically, the hybrid multi-air conditioning system 100 of the present disclosure may determine whether an abnormal refrigerant enters the evaporator or not by checking the degree of superheating of a discharged refrigerant, since the temperature control of the hot-water unit 30 is performed without control of the amount of water and direct heat transfer occurs without a Hydro Kit. Accordingly, it is possible to shut off an abnormal refrigerant by controlling the opening degree of the hot-water expansion valve 33 depending on whether the abnormal refrigerant enters or not.

The first temperature sensor 36 and the second temperature sensor 37 are respectively installed at front and rear ends of the hot-water expansion valve 33 on the hot-water discharge pipeline 35, in order to check the degree of superheating of the discharged refrigerant of the hot-water unit 30.

It is possible to measure temperatures from the first temperature sensor 36 and the second temperature sensor 37 and to determine whether an abnormal refrigerant is entering the evaporator from the hot-water unit 30 based on a temperature difference of the refrigerant passing through the hot-water expansion valve 33.

Also, in the outdoor unit 10, the third temperature sensor 47 and the fourth temperature sensor 48 are respectively installed at front and rear ends of the outdoor unit expansion valve 17 on the liquid pipe connecting pipeline 44, in order to check the degree of superheating of the discharged refrigerant of the outdoor heat exchanger 11 of the outdoor unit 10.

It is possible to measure temperatures from the third temperature sensor 47 and the fourth temperature sensor 48 and determine whether an abnormal refrigerant is entering the evaporator from the outdoor unit 10 based on a temperature difference of the refrigerant passing through the outdoor unit expansion valve 17.

Also, in the hybrid multi-air conditioning system 100 according to the first embodiment of the present disclosure, the fifth temperature sensor 24 and the sixth temperature sensor 25 are respectively installed at front and rear ends of each indoor unit expansion valve 22 of each indoor intake pipeline 26.

It is possible to measure temperatures from the fifth temperature sensor 24 and the sixth temperature sensor 25 and to determine, in space heating operation, whether an abnormal refrigerant is entering the evaporator from the indoor unit 20 based on a temperature difference of the refrigerant passing through the indoor unit expansion valve 22.

The hybrid multi-air conditioning system 100 according to the one embodiment of the present disclosure may be operated in a cooling and hot-water heating operation or in a space heating and hot-water heating operation.

Hereinafter, the operation of the system for each operation mode will be described in detail.

Figure 3:
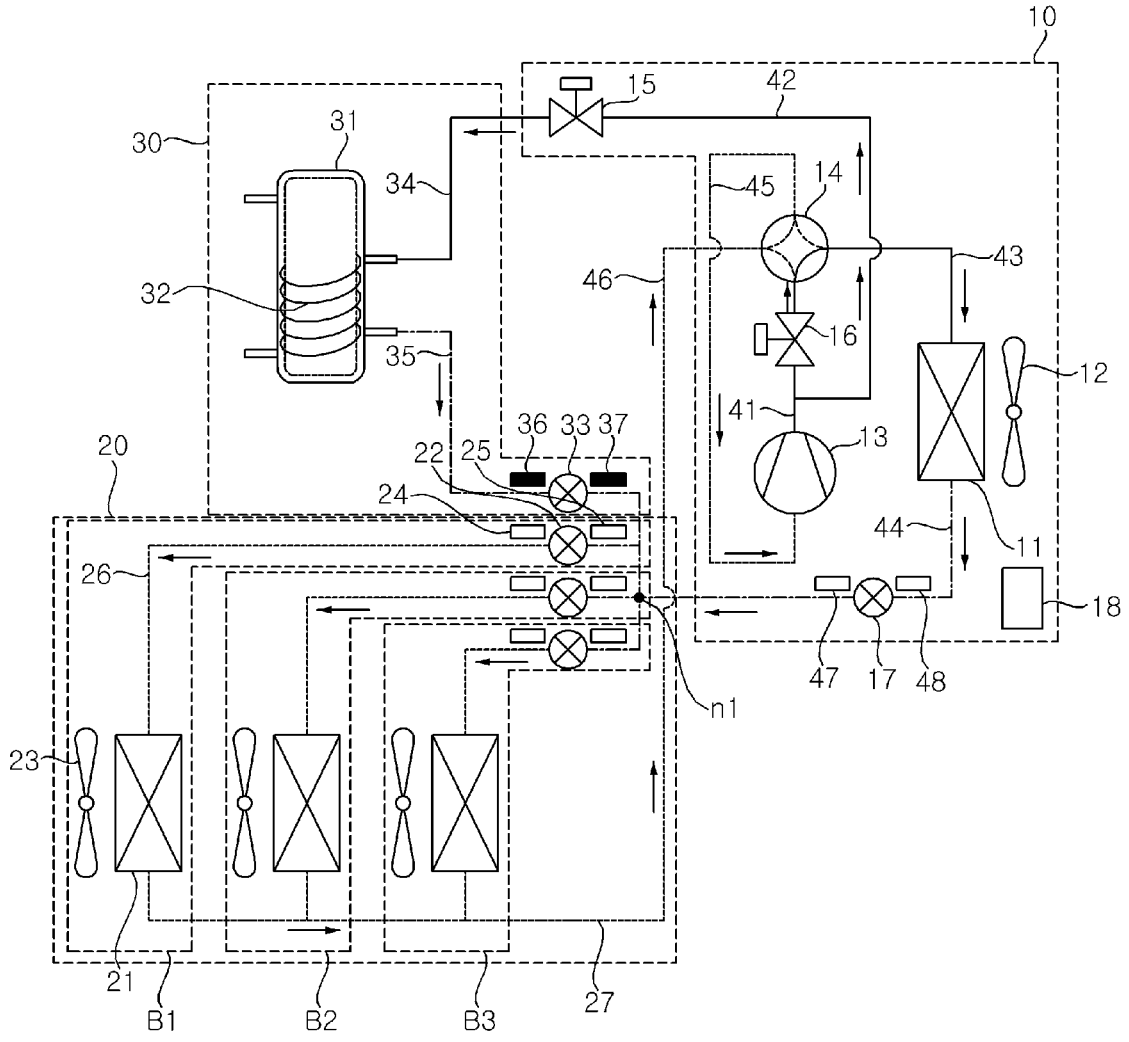
FIG. 3 is an operational diagram of a hot-water heating and cooling operation of the hybrid multi-air conditioning system of FIG. 2.
Figure 4:
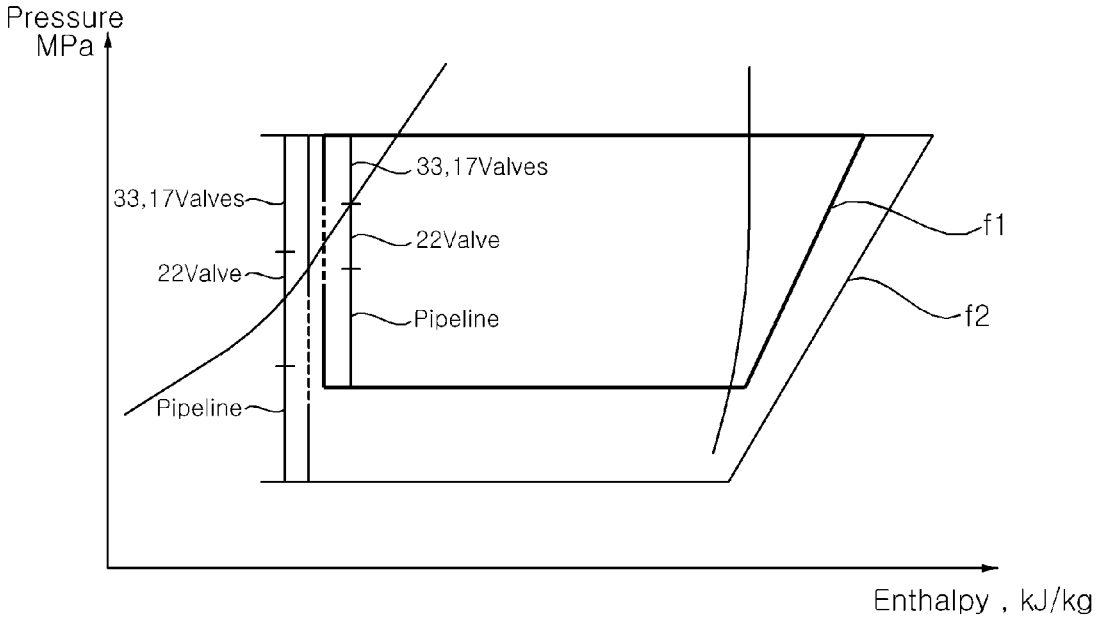
FIG. 4 is a graph illustrating valve control during the hot-water heating and cooling operation of FIG. 3.
Figure 5:
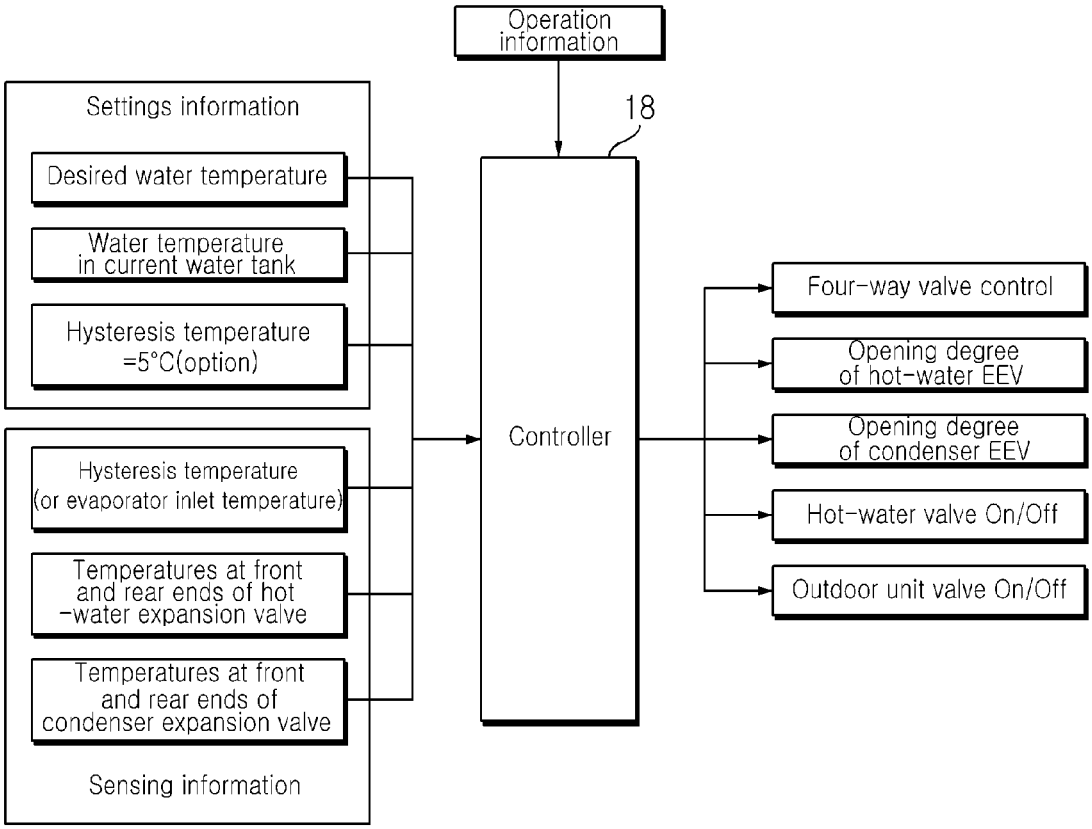
FIG. 5 shows a controller to illustrate the control of the hybrid multi-air conditioning system of FIG. 2.
Figure 6:
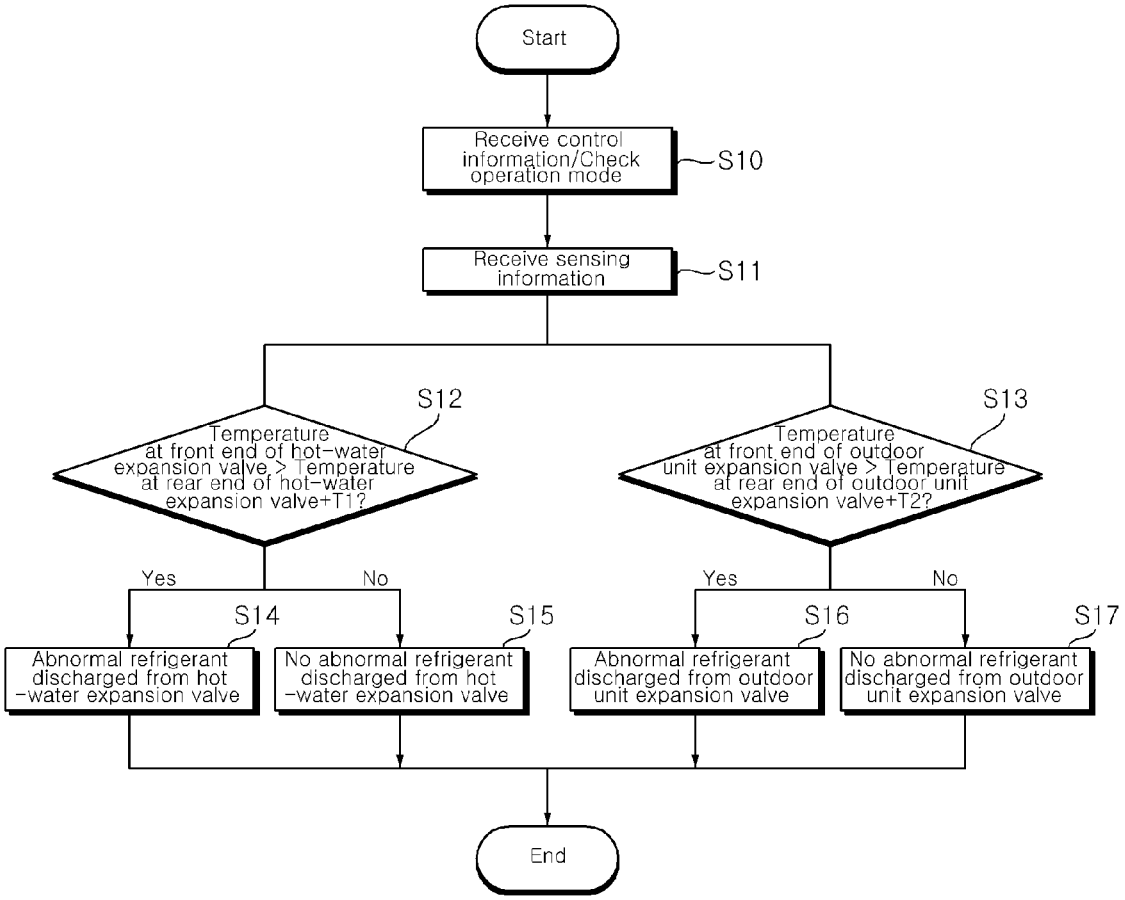
FIG. 6 is a sequential chart for valve control during the hot-water heating and cooling operation of the hybrid multi-air conditioning system of FIG. 3.

FIG. 3 is an operational diagram of a cooling and hot-water heating operation of the hybrid multi-air conditioning system of FIG. 2. FIG. 4 is a graph illustrating valve control during the cooling and hot-water heating operation of FIG. 3. FIG. 5 shows a controller 18 to illustrate the control of the hybrid multi-air conditioning system of FIG. 2. FIG. 6 is a sequential chart for valve control during the cooling and hot-water heating operation of the hybrid multi-air conditioning system of FIG. 3.

First of all, once the cooling and hot-water heating operation of the hybrid multi-air conditioning system according to the one embodiment of the present disclosure is started, the flow of refrigerant proceeds as shown in FIG. 3.

When the cooling and hot-water heating operation is started, the heat exchangers 11 and 32 of the outdoor unit 10 and hot-water unit 30 operate as condensers and the heat exchanger 21 of the indoor unit 20 operates as an evaporator.

Specifically, the refrigerant turns into a high-pressure vapor after the compressor 13 is run, and part of the refrigerant passes through the outdoor unit valve 16 and then the four-way valve 14 and is sent to the outdoor heat exchanger 11, and the rest of the refrigerant passes through the hot-water valve 15 and is sent to the hot-water heat exchanger 32. The high-pressure, high-temperature refrigerants sent to the outdoor heat exchanger 11 and the hot-water heat exchanger 32 exchange heat with the outside air and the water in the water tank 31, respectively, thereby heating the water in the water tank 31 and condensing into liquid form.

The condensed liquid refrigerants pass through the outdoor unit expansion valve 17 and the hot-water expansion valve 33, join at the first node n1, and are then transferred as a low-pressure refrigerant to the indoor heat exchanger 21 from the first node n1 through the indoor unit expansion valve 22 of the indoor unit 20 performing cooling operation.

The low-pressure refrigerant enters the indoor unit 20 and then evaporates via heat exchange with the inside air. As the low-pressure refrigerant cools the inside air, it passes through the four-way valve 14 via the low-pressure connecting pipeline 46 and flows to the intake pipeline 45 of the compressor 13 and re-enters the compressor 13.

In the flow of refrigerant shown in FIG. 3, when heat transfer occurs in direct contact with the water tank 31 without using a Hydro Kit as in the one embodiment of the present disclosure, the amount of heat of condensation varies with the water temperature in the water tank 31 and the amount of water used by the user and therefore the point of control of the heat exchanger 32 serving as the condenser of the water tank 31 also varies.

Moreover, when the condensed refrigerant directly enters the indoor unit 20 without a receiver at an outlet of the condenser, as in the one embodiment of the present disclosure, the maximum degree of subcooling suitable for a temperature condition and the amount of charge need to be controlled by properly regulating the opening degree of the hot-water expansion valve 33 in order to control the heating temperature for the water in the water tank 31.

In addition, when there is no receiver, the receiver's function—that is, a function for filtering out the low-pressure liquid refrigerant alone and transferring it to the evaporator side (the indoor heat exchanger 21 of FIG. 3). In the hybrid multi-air conditioning system 100 capable of both hot-water heating and cooling, when there is no such function, two condensers are provided at the hot-water heating side and the outdoor unit side, respectively, as illustrated in the graph of FIG. 4, thereby increasing the condensation capacity.

In this structure, the hot-water expansion valve 33 and the outdoor unit expansion valve 17 are installed at an outlet end of the hot-water unit 30 and an outlet end of the outdoor unit 10, respectively, and a liquid refrigerant is sent to the indoor unit expansion valve 22.

The refrigerant discharged from each condenser needs to pass through two expansion valves—more specifically, through the hot-water expansion valve 33 and the indoor unit expansion valve 22 or through the outdoor unit expansion valve 17 and the indoor unit expansion valve 22, and normal pressure distribution occurs as in the line f1 in the graph due to pressure reductions in the expansion valves 33 and 22 or 17 and 22 and the liquid pipe connecting pipeline 44.

In this case, when only the liquid refrigerant enters the indoor unit expansion valve 22, pressure distribution occurs as in the line f1 in the graph, and the liquid refrigerant enters the indoor unit heat exchanger 21 without a large pressure loss within the indoor unit expansion valve 22, thereby allowing for evaporation without a drop in evaporation temperature.

On the other hand, as shown in the line f2 in the graph, when a refrigerant discharged from the condenser enters the evaporator in the form of an abnormal refrigerant with gas and liquid mixed in it, this causes a significantly large pressure loss at the evaporator expansion valve, leading to a large drop in evaporation temperature.

Such a drop in evaporation temperature may involve the risk of cycle hunting and entry into limited control.

In the one embodiment of the present disclosure, the opening degrees of the expansion valves 33 and 17 are controlled by determining whether an abnormal refrigerant enters the evaporator, i.e., the heat exchanger 21 of the indoor unit 20 as shown in FIG. 3, thereby removing the abnormal refrigerant and controlling the maximum degree of subcooling.

To this end, in the one embodiment of the present disclosure, the controller 18 is included which controls the amount of refrigerant in the hot-water unit 30 and the degree of subcooling by controlling the expansion valves 33 and 17.

Referring to FIG. 5, the controller 18 may be implemented as a processor installed inside the outdoor unit and control the overall system. Particularly, the controller 18 may control the opening degrees of the expansion valves 33, 17, and 22 or the on/off of the hot-water valve 15 and the outdoor unit valve 16 by reading the temperatures at the front and rear ends of the expansion valves 33, 17, and 22 by means of a plurality of temperature sensors.

Specifically, when the outdoor unit 10 and the indoor unit 20 correspond to a condenser and an evaporator, respectively, in cooling operation and the outdoor unit 20 and the outdoor unit 10 correspond to a condenser and an evaporator, respectively, in heating operation, each valve is controlled by controlling the mode change of each unit and periodically reading operation information, settings information, and sensing information from the user.

The operation information may be selection information received from the user that indicates which operation mode is selected among hot-water heating and cooling operation, cooling-only operation, hot-water heating and space heating operation, space heating-only operation, and hot-water heating-only operation.

The settings information may include a desired water temperature, a current water temperature in the water tank 31, and a hysteresis temperature, and also may include threshold settings in each process.

The hysteresis temperature is defined as a temperature value that may raise the water temperature in the water tank 31 by residual heat in the heat exchanger 32 if no refrigerant flows in the heat exchanger 32 wound on the water tank 31 of the hot-water unit 30.

As the sensing information, the temperatures at the front and rear ends of the hot-water expansion valve 33, the temperatures at the front and rear ends of the condenser expansion valves 33 and 17, and the inlet temperature of the evaporator may be received.

At this point, the indoor unit 20 and the outdoor unit 10 may selectively function as a condenser and an evaporator according to each operation mode.

The controller 18 controls the hot-water expansion valve 33 and the expansion valve 17 and 22 of the indoor unit 20 and outdoor unit 10 serving as the condenser to control the maximum degree of subcooling. In this case, the maximum degree of subcooling refers to a degree of subcooling at which no abnormal refrigerant enters the expansion valve 17 and 22 of the evaporator.

That is, the controller 18 periodically receives a sensed temperature signal from each temperature sensor, and accordingly controls the opening degree of each expansion valve by determining whether an abnormal refrigerant is currently entering the evaporator.

Hereinafter, the detection of abnormal refrigerant discharge by the controller 18 will be described with reference to FIG. 6.

Referring to FIG. 6, the controller 18 receives information for control, checks the current mode of operation, and checks whether the hot-water unit, the outdoor unit, and the indoor unit are operating according to the current mode of operation (S10).

Specifically, if the current mode of operation is a cooling and hot-water heating operation mode, it is checked whether the hot-water heat exchanger 32 of the hot-water unit 30 and the outdoor heat exchanger 11 of the outdoor unit 10 operate as condensers and whether the indoor heat exchanger 21 of the indoor unit 20 operates as an evaporator.

When each unit operates according to their corresponding mode, the controller 18 regulates the opening degree of the indoor unit expansion valve 22 by targeting the discharge temperature of the compressor 13 as in general cycle control, and ensures that each condenser has the maximum degree of subcooling by decreasing the opening degrees of the hot-water expansion valve 33 and the outdoor unit expansion valve 17.

In this case, the controller 18 periodically receives temperature sensing information from a plurality of temperature sensors 36, 37, 47, 48, 24, and 25 during regular control and accordingly determines whether an abnormal refrigerant enters the indoor unit 20 (S11).

First of all, the controller 18 receives the temperatures of the front and rear ends of the hot-water expansion valve 33 from the first temperature sensor 36 and second temperature sensor 37 installed on the hot-water expansion valve 33.

In this instance, the controller 18 determines whether the temperature of the front end of the expansion valve 33 is greater than the sum of the temperature of the rear end of the hot-water expansion valve 33 and a first threshold T1 (S12).

That is, if the temperature difference between the front and rear ends of the hot-water expansion valve 33 is greater than the first threshold T1, it is determined that an abnormal refrigerant is discharged from the hot-water expansion valve 33 due to a sharp temperature drop (S14).

In this case, the first threshold T1 may range between 1 and 3° C., preferably, 1.5° C. but is not limited to it.

Meanwhile, if the temperature difference between the front and rear ends of the hot-water expansion valve 33 is less than or equal to the first threshold T1, it is determined that no abnormal refrigerant is discharged from the hot-water expansion valve 33 (S15).

Meanwhile, the controller 18 receives the temperatures of the front and rear ends of the outdoor unit expansion valve 17 from the third temperature sensor 47 and fourth temperature sensor 48 installed on the outdoor unit expansion valve 17.

In this instance, the controller 18 determines whether the temperature of the front end of the expansion valve 17 is greater than the sum of the temperature of the rear end of the hot-water expansion valve 33 and a second threshold T1 (S13).

That is, if the temperature difference between the front and rear ends of the outdoor unit expansion valve 17 is greater than the second threshold T2, it is determined that an abnormal refrigerant is discharged through the outdoor unit expansion valve 17 due to a sharp temperature drop (S16).

In this case, the second threshold T2 may be equal to the first threshold T1, for example, between 1 and 3° C., preferably, 1.5° C. but is not limited to it.

Meanwhile, if the temperature difference between the front and rear ends of the outdoor unit expansion valve 17 is less than or equal to the second threshold T2, it is determined that no abnormal refrigerant is discharged from the outdoor unit expansion valve 17 (S17).

In this way, the controller 18 may periodically receive temperature information from the temperature sensors, accordingly determine whether an abnormal refrigerant is discharged from each condenser while the corresponding expansion valves 33 and 17 are currently opened at a predetermined degree, and accordingly control the opening degrees of the expansion valves 33 and 17.

Hereinafter, referring to FIGS. 7 and 8, the detection of abnormal refrigerant discharge during the space heating and hot-water heating operation of the hybrid multi-air conditioning system according to the one embodiment of the present disclosure will be described.

Figure 7:
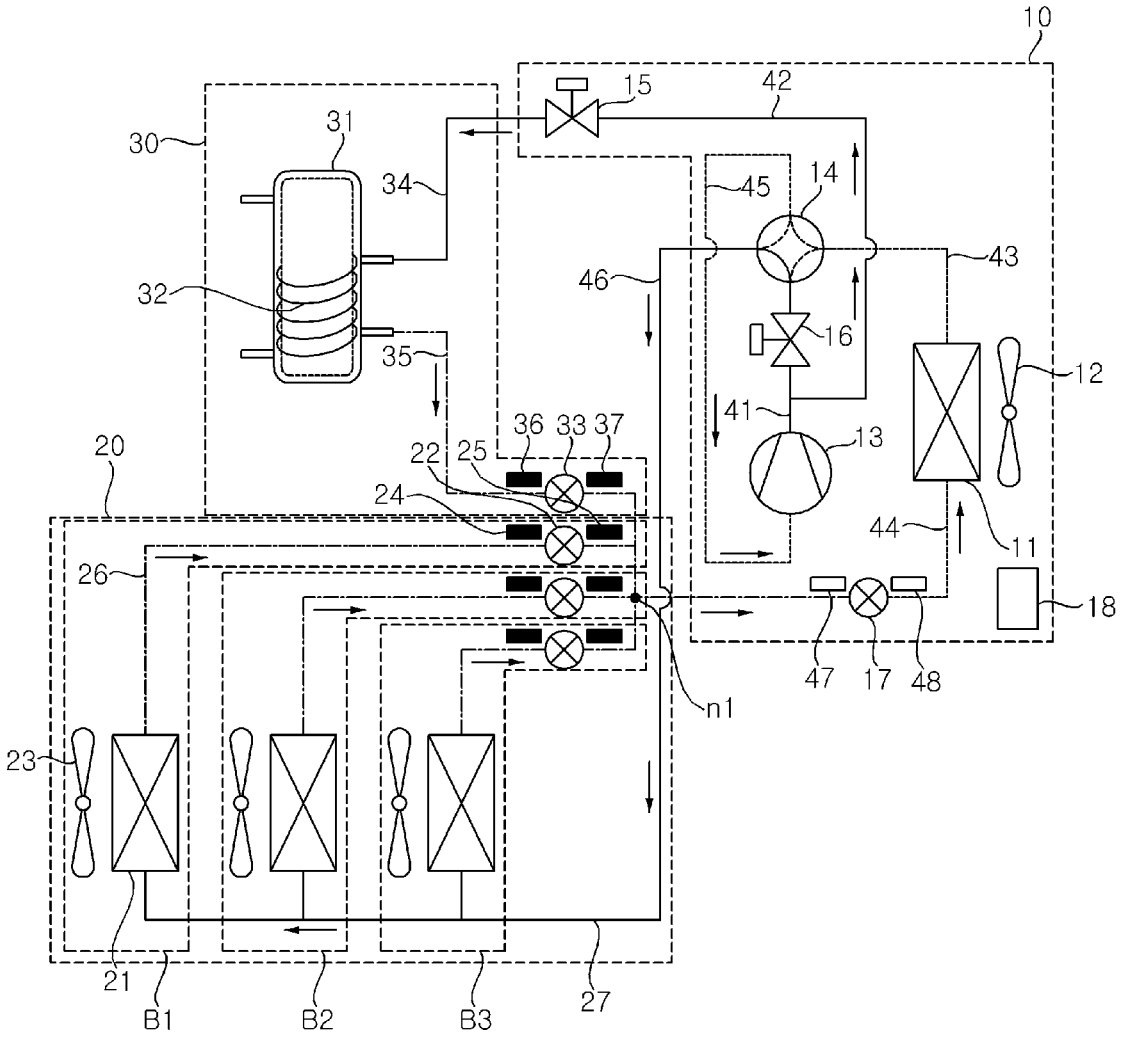
FIG. 7 is an operational diagram of a hot-water heating and space heating operation of the hybrid multi-air conditioning system of FIG. 2.

FIG. 7 is an operational diagram of a hot-water heating and space heating operation of the hybrid multi-air conditioning system of FIG. 2. FIG. 8 is a sequential chart for valve control during the hot-water heating and space heating operation of the hybrid multi-air conditioning system of FIG. 7.

Referring to FIG. 7, when the hot-water heating and space heating operation is started, the heat exchangers 21 and 32 of the indoor unit 20 and hot-water unit 30 operate as condensers and the heat exchanger 11 of the outdoor unit 10 operates as an evaporator.

Specifically, the refrigerant turns into a high-pressure vapor after the compressor 13 is run, and part of the refrigerant passes through the outdoor unit valve 16 and then the four-way valve 14 and is sent to at least one indoor heat exchanger 21, and the rest of the refrigerant passes through the hot-water valve 15 and is sent to the hot-water heat exchanger 32. The high-pressure, high-temperature refrigerants sent to the indoor heat exchanger 21 and the hot-water heat exchanger 32 exchange heat with the inside air and the water in the water tank 31, respectively, thereby heating the inside air and the water in the water tank 31 and condensing into liquid form.

The condensed liquid refrigerants pass through the indoor unit expansion valve 22 and the hot-water expansion valve 33, join at the first node n1, and are then transferred as a low-pressure refrigerant to the outdoor heat exchanger 11 from the first node n1 through the outdoor unit expansion valve 17 of the outdoor unit 10.

The low-pressure refrigerant enters the outdoor unit 10 and then evaporates via heat exchange with the outside air, and passes through the four-way valve 14 and flows to the intake pipeline 45 of the compressor 13 and re-enters the compressor 13.

In the space heating and hot-water heating operation, the opening degrees of the expansion valves 33, 22, and 17 are controlled by determining whether an abnormal refrigerant enters the outdoor heat exchanger 11 of the outdoor unit 10, thereby removing the abnormal refrigerant and controlling the maximum degree of subcooling.

To this end, in the one embodiment of the present disclosure, the amount of refrigerant in the hot-water unit 30 and the degree of subcooling are controlled by controlling the expansion valves 33, 22, and 17.

Figure 8:
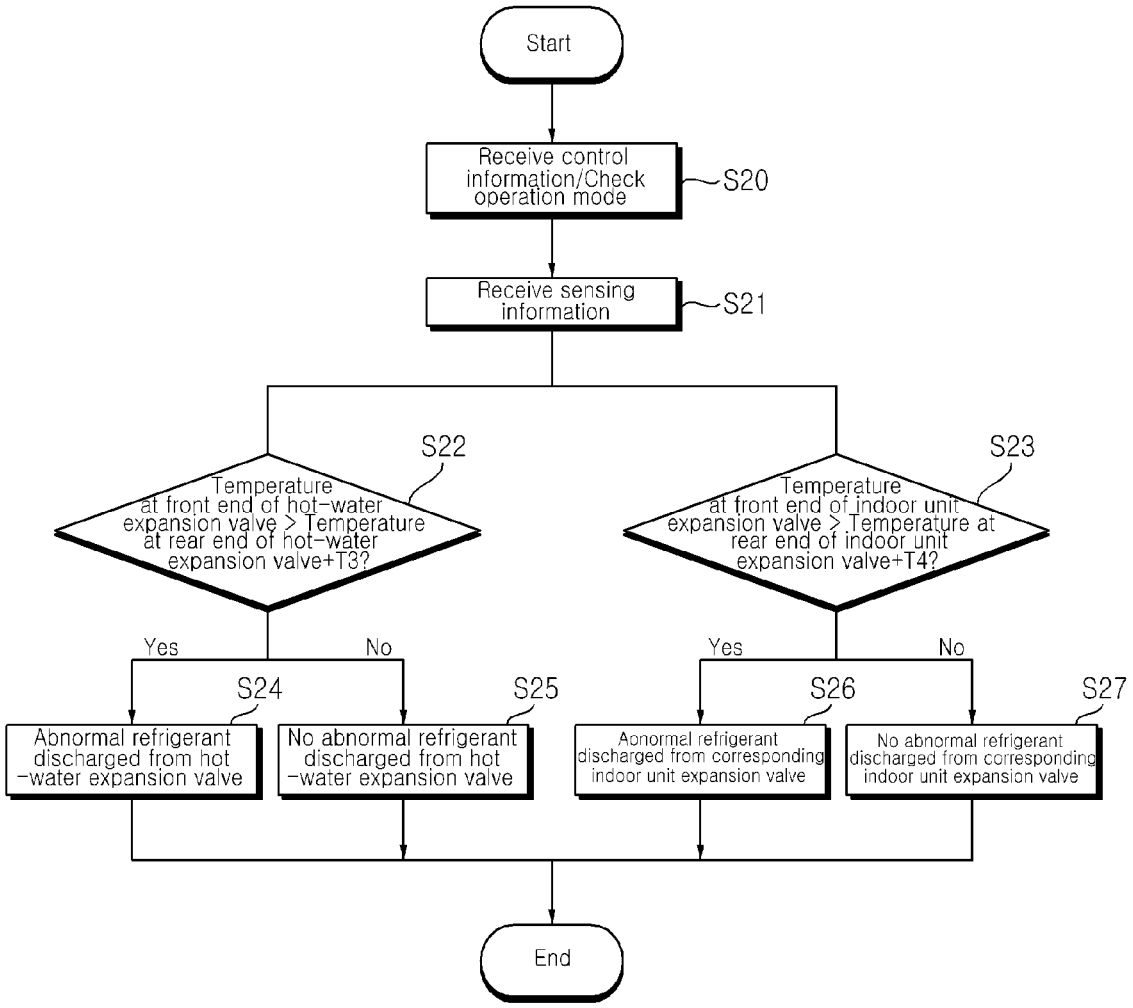
FIG. 8 is a sequential chart for valve control during the hot-water heating and space heating operation of the hybrid multi-air conditioning system of FIG. 7.

Referring to FIG. 8, the controller 18 periodically receives temperature sensing information from a plurality of temperature sensors 36, 37, 47, 48, 24, and 25 during regular control and accordingly determines whether an abnormal refrigerant enters the outdoor unit 10.

Specifically, the controller 18 receives information for control, checks the current mode of operation, and checks whether the hot-water unit 30, the outdoor unit 10, and the indoor unit 20 are operating according to the current mode of operation (S20).

If the current mode of operation is a space heating and hot-water heating operation mode, it is checked whether the hot-water heat exchanger 32 of the hot-water unit 30 and the indoor heat exchanger 21 of the indoor unit 20 operate as condensers and whether the outdoor heat exchanger 11 of the outdoor unit 10 operates as an evaporator.

When each unit 10, 20, and 30 operates according to their corresponding mode, the controller 18 regulates the opening degree of the outdoor unit expansion valve 17 by targeting the discharge temperature of the compressor 13 as in general cycle control, and ensures that each condenser has the maximum degree of subcooling by decreasing the opening degrees of the hot-water expansion valve 33 and the indoor unit expansion valve 22.

In this instance, the controller 18 receives temperature sensing information from a plurality of temperature sensors in order to determine whether an abnormal refrigerant is discharged (S21).

First of all, the controller 18 receives the temperatures of the front and rear ends of the hot-water expansion valve 33 from the first temperature sensor 36 and second temperature sensor 37 installed on the hot-water expansion valve 33.

In this instance, the controller 18 determines whether the temperature of the front end of the expansion valve 33 is greater than the sum of the temperature of the rear end of the hot-water expansion valve 33 and a third threshold T3 (S22).

That is, if the temperature difference between the front and rear ends of the hot-water expansion valve 33 is greater than the third threshold T3, it is determined that an abnormal refrigerant is discharged from the hot-water expansion valve 33 due to a sharp temperature drop (S24).

In this case, the third threshold T3 may range between 1 and 3° C., preferably, 1.5° C. but is not limited to it.

Meanwhile, if the temperature difference between the front and rear ends of the hot-water expansion valve 33 is less than or equal to the third threshold T3, it is determined that no abnormal refrigerant is discharged from the hot-water expansion valve 33 (S25).

Meanwhile, the controller 18 receives the temperatures of the front and rear ends of the indoor unit expansion valve 22 from the fifth temperature sensor 24 and sixth temperature sensor 25 installed on the indoor unit expansion valve 22.

In this instance, the controller 18 determines whether the temperature of the front end of the expansion valve 22 is greater than the sum of the temperature of the rear end of the expansion valve 22 and a fourth threshold T4 (S23).

That is, if the temperature difference between the front and rear ends of the indoor unit expansion valve 22 is greater than the fourth threshold T4, it is determined that an abnormal refrigerant is discharged from the indoor unit expansion valve 22 due to a sharp temperature drop (S26).

In this case, the fourth threshold T4 may be equal to the third threshold T3, for example, between 1 and 3° C., preferably, 1.5° C. but is not limited to it.

Meanwhile, if the temperature difference between the front and rear ends of the indoor unit expansion valve 22 is less than or equal to the fourth threshold T4, it is determined that no abnormal refrigerant is discharged from the indoor unit expansion valve 22 (S27).

In this way, the controller 18 may periodically receive temperature information from the temperature sensors 36, 37, 47, 48, 24, and 25, accordingly determine whether an abnormal refrigerant is discharged from each condenser while the corresponding expansion valves 33, 17, and 22 are currently opened at a predetermined degree, and accordingly control the opening degrees of the expansion valves 33, 17, and 22.

Valve control resulting from abnormal refrigerant discharge will be explained later in further details.

Hereinafter, a hybrid multi-air conditioning system according to another embodiment of the present disclosure and a method for determining whether an abnormal refrigerant is discharged in various modes of operation will be described.

Figure 9:
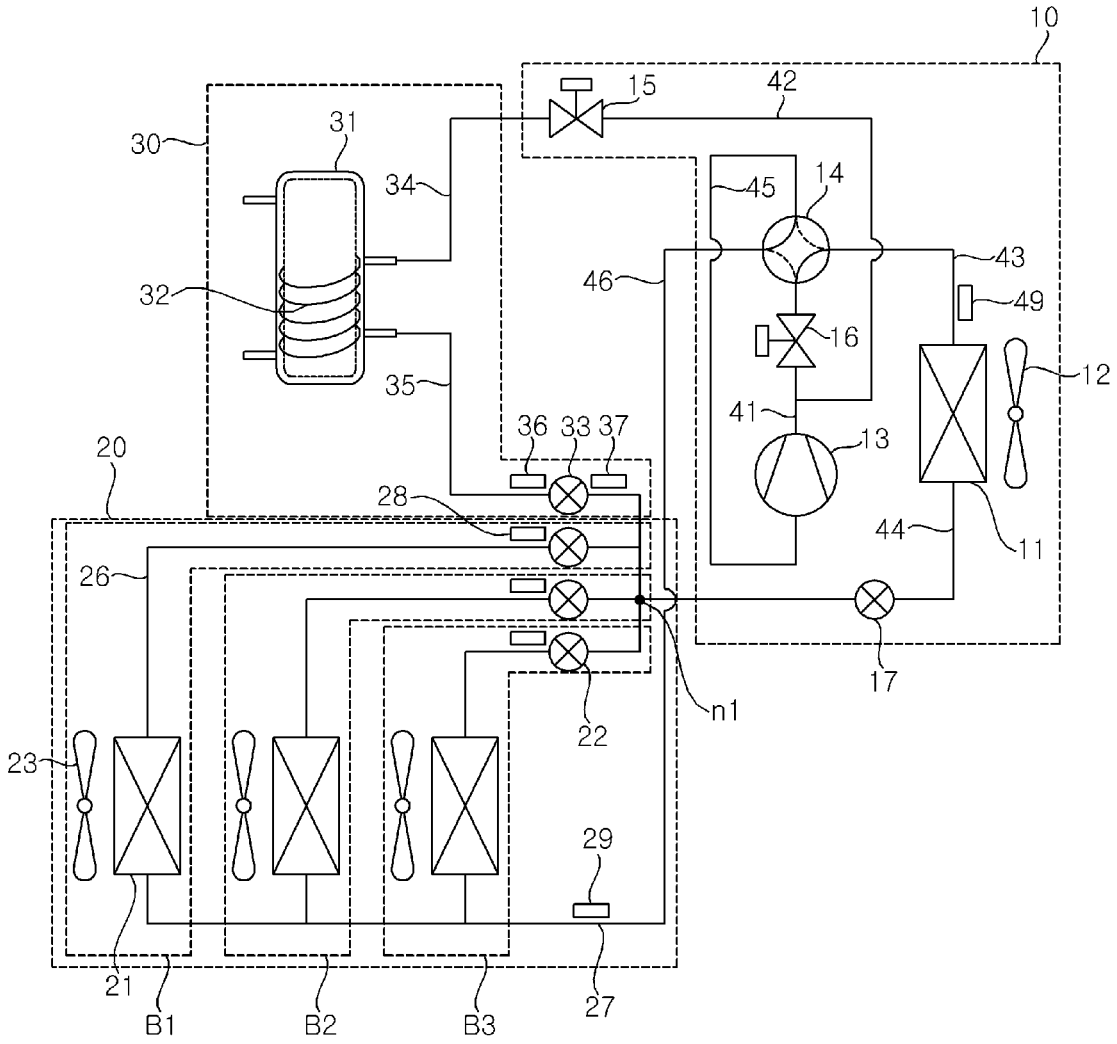
FIG. 9 is a detailed block diagram of a hybrid multi-air conditioning system according to another embodiment of the present disclosure.
Figure 10:
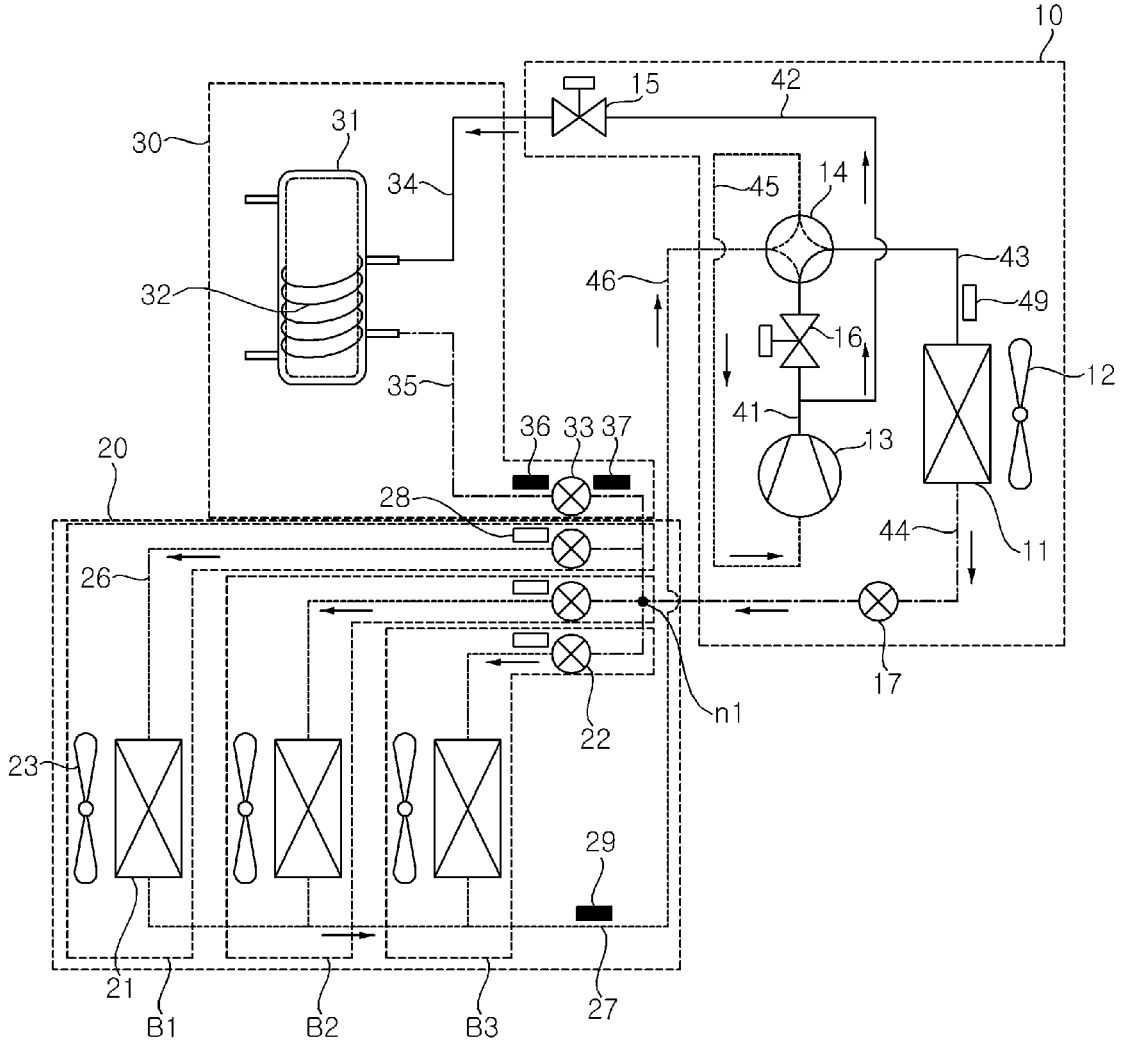
FIG. 10 is an operational diagram of a hot-water heating and cooling operation of the hybrid multi-air conditioning system of FIG. 9.
Figure 11:
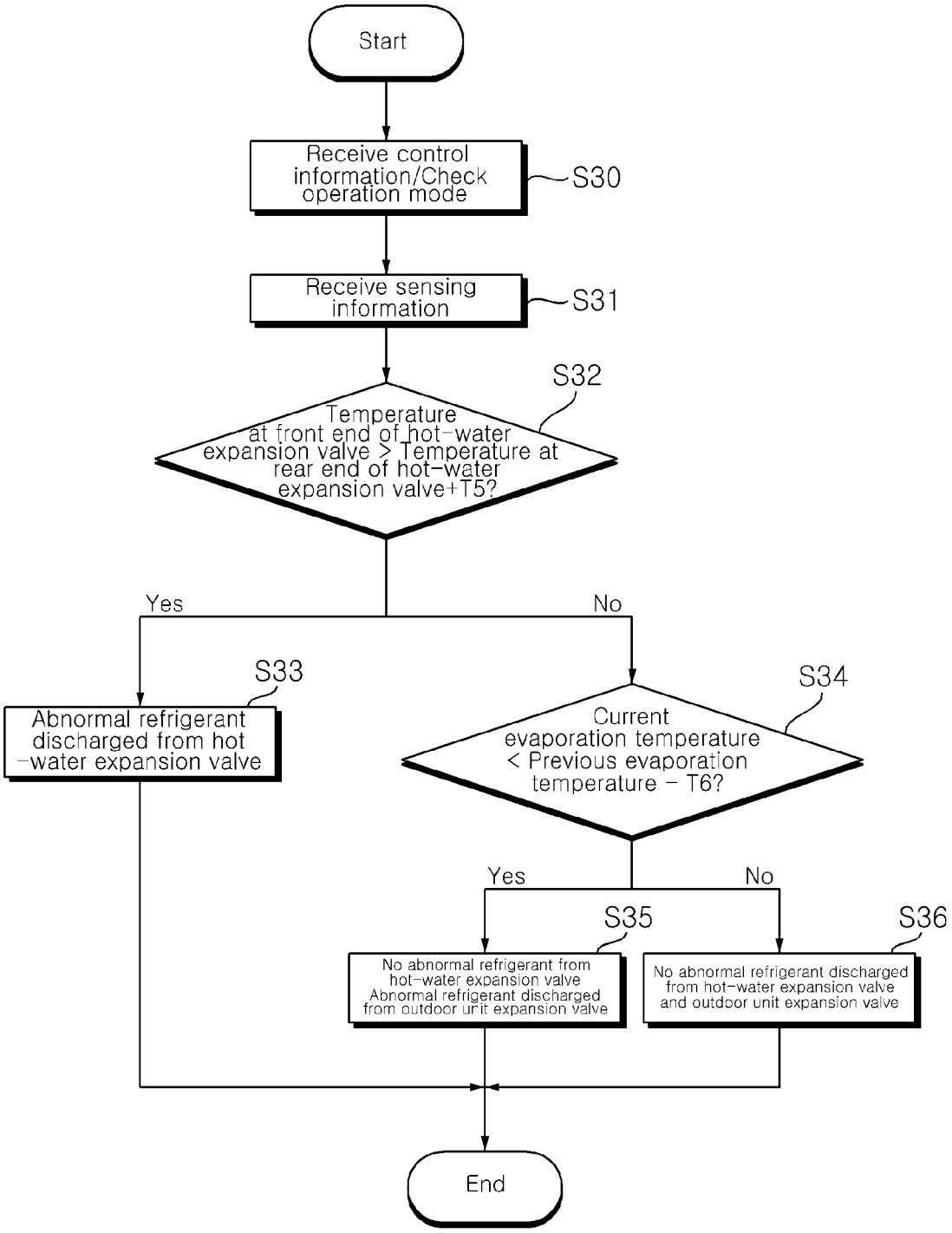
FIG. 11 is a sequential chart for valve control during the hot-water heating and cooling operation of the hybrid multi-air conditioning system of FIG. 10.

FIG. 9 is a detailed block diagram of a hybrid multi-air conditioning system according to another embodiment of the present disclosure. FIG. 10 is an operational diagram of a hot-water heating and cooling operation of the hybrid multi-air conditioning system of FIG. 9. FIG. 11 is a sequential chart for valve control during the hot-water heating and cooling operation of the hybrid multi-air conditioning system of FIG. 10.

As in FIG. 2, the hybrid multi-air conditioning system 100 according to the another embodiment of the present disclosure includes a water tank 31 for hot-water heating, a hot-water unit 30, at least one indoor unit 20 for both cooling and heating, and an outdoor unit 10 for both cooling and heating.

The hot-water unit 30 includes a long water tank 31 storing water used for hot-water heating, a water circulation pipeline (not shown) that supplies water from the outside to the bottom of the water tank 31 and releases heated water to the outside, and a hot-water heat exchanger 32 attached to an outside of the water tank 31 and connected to enable heat dissipation.

In this case, heat transfer between the water tank 31 and the hot-water heat exchanger 32 occurs via heat transfer between a refrigerant flowing through the hot-water heat exchanger 32 and water inside the water tank 31, and the hot-water heat exchanger 32 operates as a condenser that performs heat dissipation.

The hot-water heat exchanger 32 may perform heat transfer by increasing the contact area in such a way that a pipeline through which refrigerant flows is wound directly on the outside of the water tank 31 in coil form. Also, the hot-water heat exchanger 32 has a hot-water inlet pipeline 34 connected to a second discharge pipeline of the outdoor unit, and a hot-water discharge pipeline 35 that causes a refrigerant to flow after heat exchange with the water tank 31.

The hot-water discharge pipeline 35 may be connected to a first node n1 connecting the indoor unit 20, the outdoor unit 10, and the hot-water unit 30, and a hot-water expansion valve 33 may be disposed on the hot-water discharge pipeline 35 of the hot-water heat exchanger 32.

The hot-water expansion valve 33 provided on a discharge portion of the hot-water heat exchanger 32 may be an electronic expansion valve, and may regulate the flow of refrigerant flowing through the piping of the hot-water heat exchanger 32 and cause a condensed refrigerant to flow to the outdoor unit 10 or the indoor unit 20.

Meanwhile, the outdoor unit 10 for both cooling and heating includes a compressor 13, an outdoor heat exchanger 11, an outdoor heat exchanger fan 12, and a four-way valve 14. The compressor has the same construction as in FIG. 2.

A low-pressure connecting pipeline 46 connected to the indoor unit 20 is connected to an intake pipeline 45 of the compressor 13 via the four-way valve 14. First and second discharge pipelines 42 and 43 are connected to a discharge portion 41 of the compressor 13, the first discharge pipeline 43 allows a discharged refrigerant to flow to the outdoor heat exchanger 11, and the second discharge pipeline 42 allows the discharged gaseous refrigerant of high temperature and high pressure to flow to the hot-water unit 30 and is connected to the hot-water heat exchanger 32.

The first discharge pipeline 43 is connected between the discharge portion 41 of the compressor and the four-way valve 14 and connected to the outdoor heat exchanger 11, and the second discharge pipeline 42 is connected to the hot-water heat exchange 32 such that the refrigerant discharged from the compressor 13 bypasses the four-way valve 14 without passing through it.

The outdoor heat exchanger 11 is connected to the four-way valve 14 by the first discharge pipeline 43. Refrigerant condenses or evaporates in the outdoor heat exchanger 11 via heat exchange with outside air.

An outdoor unit electronic expansion valve 17 is installed on the liquid pipe connecting pipeline 44 connecting the outdoor heat exchanger 11 and the indoor unit 20. The outdoor unit electronic expansion valve 17 expands refrigerant during heating operation. During heating operation, the outdoor unit electronic expansion valve 17 expands refrigerant condensed in a plurality of indoor heat exchangers 21 before the refrigerant enters the outdoor heat exchanger 11.

The four-way valve 14 is provided on the discharge portion 14 of the compressor 13, and switches the direction of refrigerant flowing in the outdoor unit 10. The four-way valve 14 properly switches the direction of refrigerant discharged from the compressor 13 according to the cooling, hot-water heating, or space heating operation of the hybrid multi-air conditioning system 100.

The outdoor unit 10 for both cooling and heating includes a hot-water valve 15 between the second discharge pipeline 42 and the hot-water inlet pipeline 34 and an outdoor unit valve 16 between the first discharge pipeline 43 and the discharge portion 41 of the compressor 13.

The hot-water valve 15 and the outdoor unit valve 16 may be selectively operated as required. In a cooling and hot-water heating operation or in a space heating and hot-water heating operation, if a water temperature desired by the user is reached, hot-water heating is not required, and therefore the hot-water valve 15 is closed. Thus, only the outdoor unit 10 serves as a condenser during cooling operation, and only the indoor unit 20 serves as a condenser during space heating operation.

Meanwhile, the hybrid multi-air conditioning system 100 may include at least one indoor unit 20.

A plurality of indoor units 20 for both cooling and heating may be connected to one outdoor unit 10, and FIGS. 1 and 2 illustrate three indoor units B1, B2, and B3 but are not limited to them.

Each indoor unit B1, B2, and B3 for both cooling and heating includes an indoor heat exchanger 21, an indoor unit expansion valve 22, and an outdoor unit fan 23.

The respective indoor heat exchangers 22 are installed on first, second, and third indoor connecting pipelines 26 connecting the heat exchangers 21 and the first node n1.

A liquid pipe connecting pipeline 46 is installed so that the refrigerant discharged from the first, second, and third indoor units B1, B2, and B3 for both cooling and heating flows to the compressor 13. The liquid pipe connecting pipeline 46 is connected to all of the heat exchangers 21 and connected to the outdoor unit 10.

Specifically, the hybrid multi-air conditioning system 100 includes a plurality of temperature sensors 36, 37, 29, and 49 to control the flow of refrigerant in each unit.

The hybrid multi-air conditioning system 100 of the present disclosure may determine whether an abnormal refrigerant enters or not by checking the degree of superheating of a discharge refrigerant, since the temperature control of the hot-water unit 30 is performed without control of the amount of water and direct heat transfer occurs without a Hydro Kit. Accordingly, it is possible to shut off an abnormal refrigerant by controlling the opening degree of the hot-water expansion valve 33 depending on whether the abnormal refrigerant enters or not.

The first temperature sensor 36 and the second temperature sensor 37 are respectively installed at front and rear ends of the hot-water expansion valve 33 on the hot-water discharge pipeline 35, in order to check the degree of superheating of the discharged refrigerant of the hot-water unit 30.

It is possible to measure temperatures from the first temperature sensor 36 and the second temperature sensor 37 and to determine whether an abnormal refrigerant is entering based on a temperature difference of the refrigerant passing through the hot-water expansion valve 33.

Also, in the outdoor unit 10, a seventh temperature sensor 49 is installed at the outdoor heat exchanger 11 on the first discharge pipeline 43 in order to read the temperature of the discharge temperature of the outdoor heat exchanger 11 of the outdoor unit 10.

Also, in the hybrid multi-air conditioning system 100 according to the another embodiment of the present disclosure, an eighth temperature sensor 28 is installed at a front end of the indoor unit expansion valve 22 on each indoor intake pipeline 26, that is, between the indoor heat exchanger 21 and the indoor unit expansion valve 22.

Moreover, a ninth temperature sensor 29 is installed on the low-temperature connecting pipeline 46 of an outlet end of the indoor heat exchanger 21.

In this way, temperature sensors 28, 49 are respectively installed at outlet ends of evaporators corresponding to the indoor heat exchanger 21 and the outdoor heat exchanger 11 functioning as the evaporators, and a temperature sensor 29 is installed at an outlet end of a condenser, so as to determine whether an abnormal refrigerant exits the condenser and enters the evaporators by periodically reading temperatures from the temperature sensors 28, 49.

By disposing the temperatures 49, 28, and 29 in this manner, the number of temperatures sensors 49, 28, and 29 to be attached may be decreased compared to the one embodiment, which may reduce cost.

The hybrid multi-air conditioning system 100 according to the another embodiment of the present disclosure may be operated in a cooling and hot-water heating operation or in a space heating and hot-water heating operation.

First of all, once the cooling and hot-water heating operation of the hybrid multi-air conditioning system according to the another embodiment of the present disclosure is started, the flow of refrigerant proceeds as in FIG. 10.

When the cooling and hot-water heating operation is started, the heat exchangers 11 and 32 of the outdoor unit 10 and hot-water unit 30 operate as condensers and the heat exchanger 21 of the indoor unit 20 operates as an evaporator.

Specifically, the refrigerant turns into a high-pressure vapor after the compressor 13 is run, and part of the refrigerant passes through the outdoor unit valve 16 and then the four-way valve 14 and is sent to the outdoor heat exchanger 11, and the rest of the refrigerant passes through the hot-water valve 15 and is sent to the hot-water heat exchanger 32. The high-pressure, high-temperature refrigerants sent to the outdoor heat exchanger 11 and the hot-water heat exchanger 32 exchange heat with the outside air and the water in the water tank 31, respectively, thereby heating the water in the water tank 31 and condensing into liquid form.

The condensed liquid refrigerants pass through the outdoor unit expansion valve 17 and the hot-water expansion valve 33, join at the first node n1, and are then transferred as a low-pressure refrigerant to the indoor heat exchanger 21 from the first node n1 through the indoor unit expansion valve 22 of the indoor unit 20 performing cooling operation.

The low-pressure refrigerant enters the indoor unit 20 and then evaporates via heat exchange with the inside air. As the low-pressure refrigerant cools the inside air, it passes through the four-way valve 14 via the low-pressure connecting pipeline 46 and flows to the intake pipeline 45 of the compressor 13 and re-enters the compressor 13.

In the flow of refrigerant shown in FIG. 10, when heat transfer occurs in direct contact with the water tank 31 without using a Hydro Kit as in the another embodiment of the present disclosure, the amount of heat of condensation varies with the water temperature in the water tank 31 and the amount of water used by the user and therefore the point of control of the heat exchanger 32 serving as the condenser of the water tank 31 also varies.

Moreover, when the condensed refrigerant directly enters the indoor unit 20 without a receiver at an outlet of the condenser, as in the another embodiment of the present disclosure, the maximum degree of subcooling suitable for a temperature condition and the amount of charge need to be controlled by properly regulating the opening degree of the hot-water expansion valve 33 in order to control the heating temperature for the water in the water tank 31.

In the another embodiment of the present disclosure, the opening degrees of the expansion valves 17, 33, and 22 are controlled by determining whether an abnormal refrigerant enters the heat exchanger 21 of the indoor unit 20, thereby removing the abnormal refrigerant and controlling the maximum degree of subcooling.

To this end, in the another embodiment of the present disclosure, the controller 18 of FIG. 5 controls the amount of refrigerant in the hot-water unit 30 and the degree of subcooling by controlling the expansion valves 17, 33, and 22.

That is, the controller 18 periodically receives a sensed temperature signal from each temperature sensor, and accordingly controls the opening degree of each expansion valve 17, 33, and 22 by determining whether an abnormal refrigerant is currently entering an evaporator.

Hereinafter, the detection of abnormal refrigerant discharge by the controller 18 will be described with reference to FIG. 11.

Referring to FIG. 11, the controller 18 periodically receives temperature sensing information from a plurality of temperature sensors 36, 37, 49, and 29 during regular control and accordingly determines whether an abnormal refrigerant enters the indoor unit 20.

Specifically, the controller 18 receives information for control, checks the current mode of operation, and checks whether the hot-water unit 30, the outdoor unit 10, and the indoor unit 20 are operating according to the current mode of operation (S30).

If the current mode of operation is a cooling and hot-water heating operation mode, it is checked whether the hot-water heat exchanger 32 of the hot-water unit 30 and the outdoor heat exchanger 11 of the outdoor unit 10 operate as condensers and whether the indoor heat exchanger 21 of the indoor unit 20 operates as an evaporator.

When each unit operates according to their corresponding mode, the controller 18 regulates the opening degree of the indoor unit expansion valve 22 by targeting the discharge temperature of the compressor 13 as in general cycle control, and ensures that each condenser has the maximum degree of subcooling by decreasing the opening degrees of the hot-water expansion valve 33 and the outdoor unit expansion valve 17.

In this instance, the controller 18 receives temperature sensing information from a plurality of temperature sensors 36, 37, 49, and 29 in order to determine whether an abnormal refrigerant is discharged (S31).

First of all, the controller 18 receives the temperatures of the front and rear ends of the hot-water expansion valve 33 from the first temperature sensor 36 and second temperature sensor 37 installed on the hot-water expansion valve 33.

In this instance, the controller 18 determines whether the temperature of the front end of the expansion valve 33 is greater than the sum of the temperature of the rear end of the hot-water expansion valve 33 and a fifth threshold T5 (S32).

That is, if the temperature difference between the front and rear ends of the hot-water expansion valve 33 is greater than the fifth threshold T5, it is determined that an abnormal refrigerant is discharged from the hot-water expansion valve 33 due to a sharp temperature drop (S33).

In this case, the fifth threshold T5 may be equal to the first threshold T1, for example, between 1 and 3° C., preferably, 1.5° C. but is not limited to it.

Meanwhile, if the temperature difference between the front and rear ends of the hot-water expansion valve 33 is less than or equal to the fifth threshold T5, it is determined that no abnormal refrigerant is discharged from the hot-water expansion valve 33.

If no abnormal refrigerant is discharged from the hot-water expansion valve 33, the controller 18 reads the temperature of the refrigerant discharged from the indoor heat exchanger 21, i.e., the discharge temperature of the evaporator, from the ninth temperature sensor 29 installed on the indoor unit 20. The discharge temperature of the evaporator is defined as evaporation temperature.

If an evaporation temperature read in the current cycle is lower than a previous evaporation temperature in the previous cycle by a sixth threshold T6 (S34), it is determined that an abnormal refrigerant is discharged from the outdoor unit expansion valve 17.

That is, if the evaporation temperature is significantly lower than the previous value when there is no abnormal refrigerant discharged through the hot-water expansion valve 33, it is determined that an abnormal refrigerant from a condenser other than the hot-water heat exchanger 32, i.e., from the outdoor heat exchanger 11 is entering the evaporator (S35).

This is because the evaporation temperature drops more sharply when an abnormal refrigerant enters each expansion valve 22 and then exits as it is, compared to when a liquid refrigerant enters each expansion valve 22 at the front of the evaporator and then exists the evaporator as an abnormal refrigerant.

In this case, the sixth threshold T6 may be greater than the fifth threshold T5, for example, between 3 and 5° C., preferably, 1.8 to 2.2 times the fifth threshold T5.

If the sixth threshold T6 is set equal to the fifth threshold T5, it is within an evaporation temperature variation range in which the evaporation temperature may drop sharply enough over a normal cycle of an regular control period even if there is no abnormal refrigerant entering the indoor unit expansion valve 22 of the evaporator. This may cause detection error, so the sixth threshold T6 is set greater than the fifth threshold T5 in consideration of the amount of variation in the evaporation temperature of the evaporator.

Meanwhile, if the difference between the current and previous values of the evaporation temperature of the evaporator is less than the sixth threshold T6, it is determined that no abnormal refrigerant is discharged to the outdoor unit expansion valve 17 either and the detection of abnormal refrigerant discharge is finished (S36).

In this way, the controller 18 may periodically receive temperature information from the temperature sensors 36, 37, 49, and 29, accordingly determine whether an abnormal refrigerant is discharged while the corresponding expansion valves 33 and 17 are currently opened at a predetermined degree, and accordingly control the opening degrees of the expansion valves 33 and 17.

Hereinafter, referring to FIGS. 12 and 13, the detection of abnormal refrigerant discharge during the space heating and hot-water heating operation of the hybrid multi-air conditioning system according to the another embodiment of the present disclosure will be described.

Figure 12:
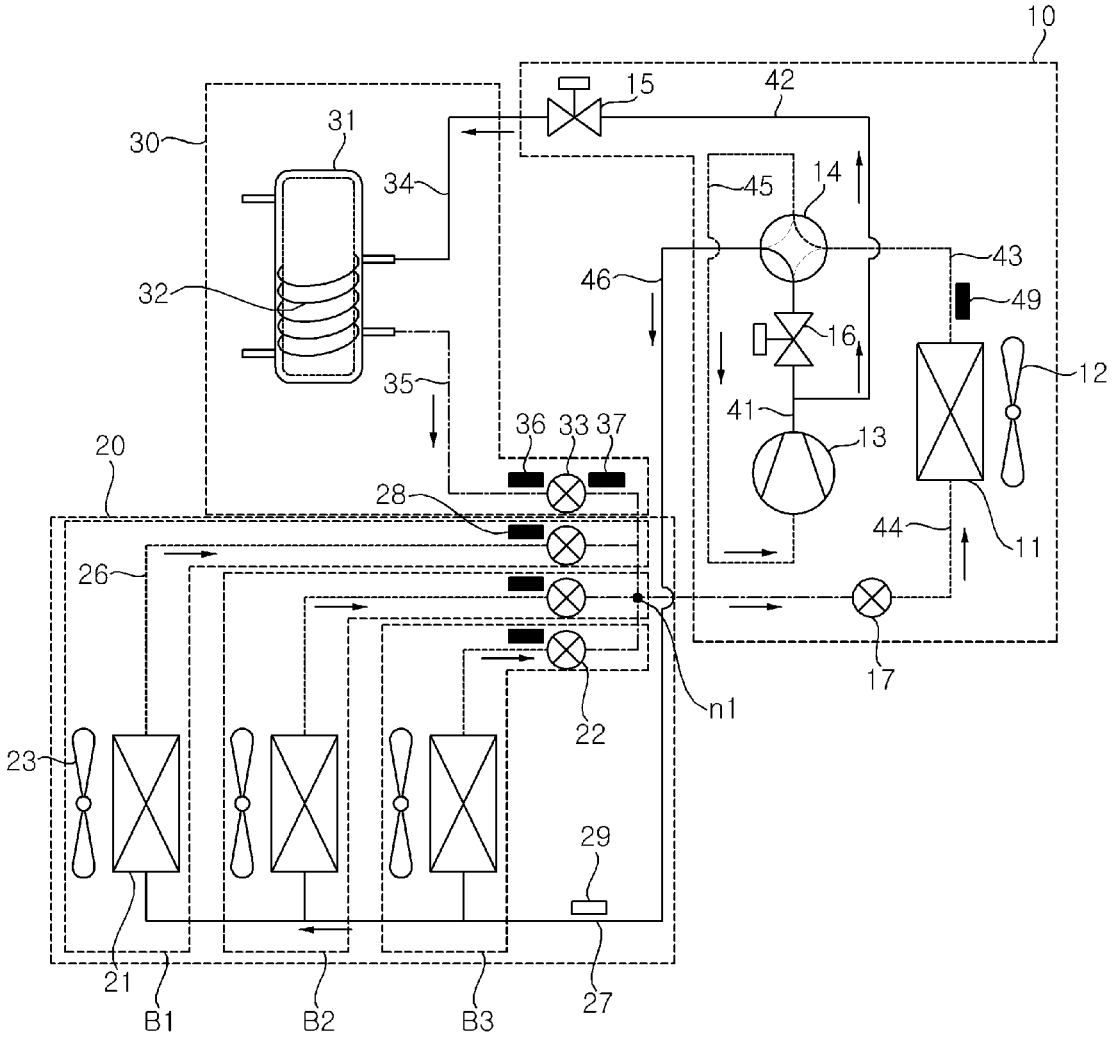
FIG. 12 is an operational diagram of a hot-water heating and space heating operation of the hybrid multi-air conditioning system of FIG. 9.

FIG. 12 is an operational diagram of a hot-water heating and space heating operation of the hybrid multi-air conditioning system of FIG. 9. FIG. 13 is a sequential chart for valve control during the hot-water heating and space heating operation of the hybrid multi-air conditioning system of FIG. 12.

Referring to FIG. 12, when the hot-water heating and space heating operation is started, the heat exchangers 21 and 32 of the indoor unit 20 and hot-water unit 30 operate as condensers and the heat exchanger 11 of the outdoor unit 10 operates as an evaporator.

Specifically, the refrigerant turns into a high-pressure vapor after the compressor 13 is run, and part of the refrigerant passes through the outdoor unit valve 16 and then the four-way valve 14 and is sent to at least one indoor heat exchanger 21, and the rest of the refrigerant passes through the hot-water valve 15 and is sent to the hot-water heat exchanger 32. The high-pressure, high-temperature refrigerants sent to the indoor heat exchanger 21 and the hot-water heat exchanger 32 exchange heat with the inside air and the water in the water tank 31, respectively, thereby heating the inside air and the water in the water tank 31 and condensing into liquid form.

The condensed liquid refrigerants pass through the indoor unit expansion valve 22 and the hot-water expansion valve 33, join at the first node n1, and are then transferred as a low-pressure refrigerant to the outdoor heat exchanger 11 from the first node n1 through the outdoor unit expansion valve 17 of the outdoor unit 10.

The low-pressure refrigerant enters the outdoor unit 10 and then evaporates via heat exchange with the outside air, and passes through the four-way valve 14 and flows to the intake pipeline 45 of the compressor 13 and re-enters the compressor 13.

In the space heating and hot-water heating operation, the opening degrees of the expansion valves 33 and 22 are controlled by determining whether an abnormal refrigerant enters the outdoor heat exchanger 11 of the outdoor unit 10, thereby removing the abnormal refrigerant and controlling the maximum degree of subcooling.

To this end, in the another embodiment of the present disclosure, the amount of refrigerant in the hot-water unit 30 and the degree of subcooling are controlled by controlling the expansion valves 33 and 22.

Figure 13:
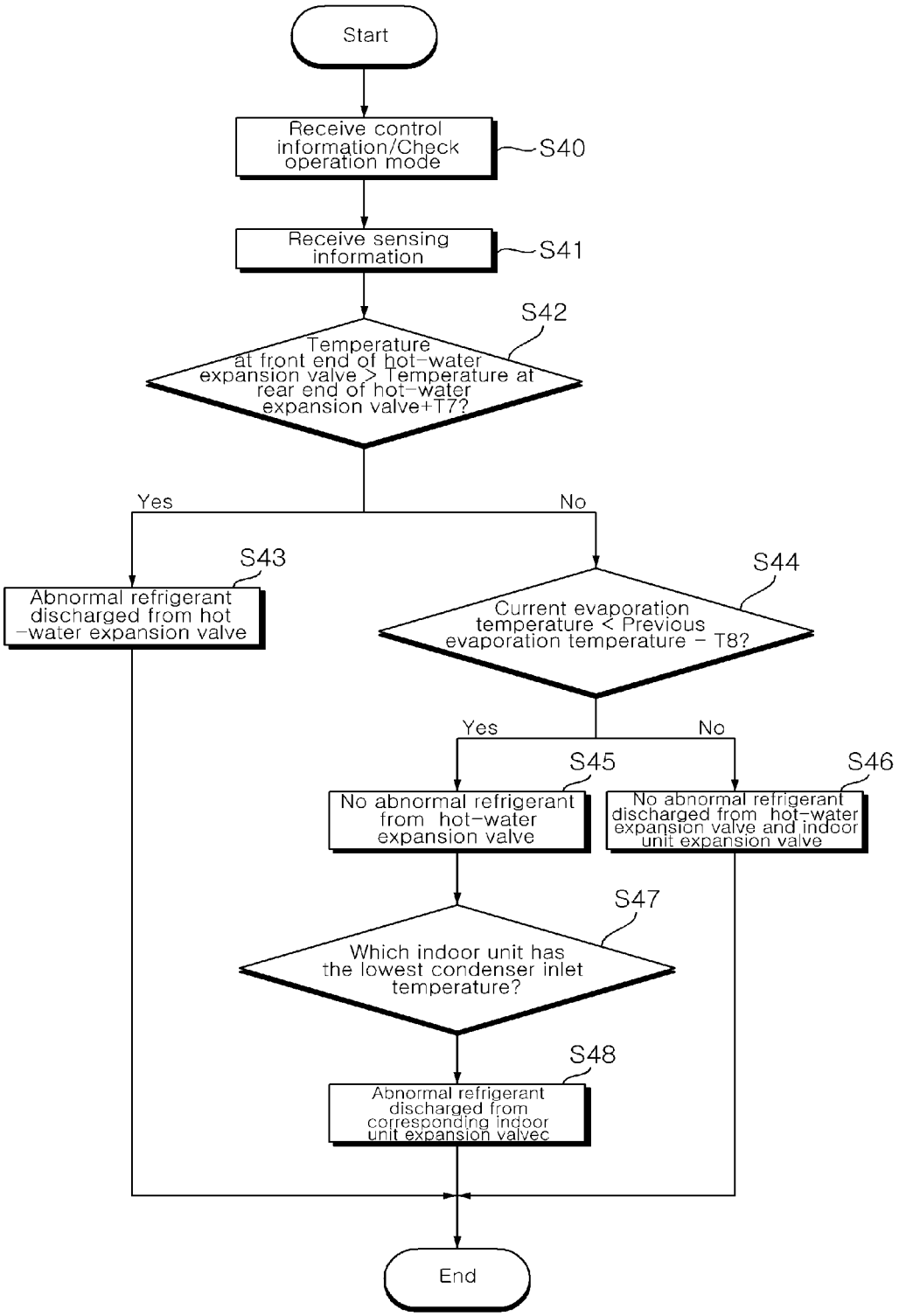
FIG. 13 is a sequential chart for valve control during the hot-water heating and space heating operation of the hybrid multi-air conditioning system of FIG. 12.

Referring to FIG. 13, the controller 18 periodically receives temperature sensing information from a plurality of temperature sensors 36, 37, 28, and 49 during regular control and accordingly determines whether an abnormal refrigerant enters the outdoor unit 10 (S11).

Specifically, the controller 18 receives information for control, checks the current mode of operation, and checks whether the hot-water unit 30, the outdoor unit 10, and the indoor unit 20 are operating according to the current mode of operation (S20).

If the current mode of operation is a space heating and hot-water heating operation mode, it is checked whether the hot-water heat exchanger 32 of the hot-water unit 30 and the indoor heat exchanger 21 of the indoor unit 20 operate as condensers and whether the outdoor heat exchanger 11 of the outdoor unit 10 operates as an evaporator.

When each unit 10, 20, and 30 operates according to their corresponding mode, the controller 18 regulates the opening degree of the outdoor unit expansion valve 17 by targeting the discharge temperature of the compressor 13 as in general cycle control, and ensures that each condenser has the maximum degree of subcooling by decreasing the opening degrees of the hot-water expansion valve 33 and the indoor unit expansion valve 22.

In this instance, the controller 18 receives temperature sensing information from a plurality of temperature sensors 36, 37, 28, and 49 in order to determine whether an abnormal refrigerant is discharged (S41).

First of all, the controller 18 receives the temperatures of the front and rear ends of the hot-water expansion valve 33 from the first temperature sensor 36 and second temperature sensor 37 installed on the hot-water expansion valve 33.

In this instance, the controller 18 determines whether the temperature of the front end of the expansion valve 33 is greater than the sum of the temperature of the rear end of the hot-water expansion valve 33 and a seventh threshold T7 (S42).

That is, if the temperature difference between the front and rear ends of the hot-water expansion valve 33 is greater than the seventh threshold T7, it is determined that an abnormal refrigerant is discharged to the hot-water expansion valve 33 due to a sharp temperature drop (S43).

In this case, the seventh threshold T7 may be equal to the fifth threshold T5, for example, between 1 and 3° C., preferably, 1.5° C. but is not limited to it.

Meanwhile, if the temperature difference between the front and rear ends of the hot-water expansion valve 33 is less than or equal to the seventh threshold T7, it is determined that no abnormal refrigerant is discharged to the hot-water expansion valve 33.

If no abnormal refrigerant is discharged to the hot-water expansion valve 33, the controller 18 reads the temperature of the refrigerant discharged from the outdoor heat exchanger 11, i.e., the discharge temperature of the evaporator, from the eighth temperature sensor 49 installed on the outdoor unit 10.

If an evaporation temperature read in the current cycle is lower than a previous evaporation temperature in the previous cycle by an eighth threshold T8 (S44), it is determined that an abnormal refrigerant is discharged from the indoor unit expansion valve 22 (S45).

That is, if the evaporation temperature is significantly lower than the previous value when there is no abnormal refrigerant discharged through the hot-water expansion valve 33, it is determined that an abnormal refrigerant from a condenser other than the hot-water heat exchanger 32, i.e., from the indoor heat exchanger 21 is entering the evaporator (S46).

In this case, the eighth threshold T8 may be greater than the seventh threshold T7, for example, between 3 and 5° C., preferably, 1.8 to 2.2 times the seventh threshold T7.

The seventh threshold T7 is within an evaporation temperature variation range in which the evaporation temperature may drop sharply enough over a normal cycle of an regular control period even if there is no abnormal refrigerant entering the indoor unit expansion valve 22 of the evaporator. This may cause detection error, so the eighth threshold T8 is set greater than the seventh threshold T7 in consideration of the amount of variation in the evaporation temperature of the evaporator.

Next, once it is determined that an abnormal refrigerant is discharged from the indoor unit expansion valve 22, it is identified from which of the plurality of indoor units B1, B2, and B3 the abnormal refrigerant is discharged (S47).

Specifically, the indoor unit B1, B2, and B3 with the lowest temperature is detected by reading the temperature of the seventh temperature sensor 28 which is the temperature sensor at the outlet end of each indoor unit B1, B2, and B3 (S47).

The controller 18 determines that the abnormal refrigerant is discharged from the indoor unit B1, B2, and B3 from which the seventh temperature sensor 28 reads the lowest temperature, and finishes the detection of abnormal refrigerant discharge (S48).

At this point, if one of the indoor units B1, B2, and B3 has a lower outlet temperature than the other indoor units B1, B2, and B3, it is determined that the abnormal refrigerant is discharged from that indoor unit B1, B2, and B3.

On the other hand, if all of the indoor units B1, B2, and B3 have the same outlet temperature or there is little difference in between their outlet temperatures, it is determined that the abnormal refrigerant is discharged from every indoor unit expansion valve 22.

Meanwhile, if the difference between the current and previous values of the evaporation temperature of the evaporator is less than the eighth threshold T8, it is determined that no abnormal refrigerant is discharged to the indoor unit expansion valve 22 either and the detection of abnormal refrigerant discharge is finished.

In this way, the controller 18 may periodically receive temperature information from the temperature sensors 36, 37, 28, 29, and 49, accordingly determine whether an abnormal refrigerant is discharged from each condenser while the corresponding expansion valves 33 and 17 are currently opened at a predetermined degree, and accordingly control the opening degrees of the expansion valves 33 and 17.

Hereinafter, a method for controlling the hybrid multi-air conditioning system 100 according to the one and another embodiments of the present disclosure will be described, in which an abnormal refrigerant is shut off while reaching a desired water temperature by controlling the flow of refrigerant according to the modes of the hot-water unit 30 and the indoor units 20 without using a receiver.

Figure 14:
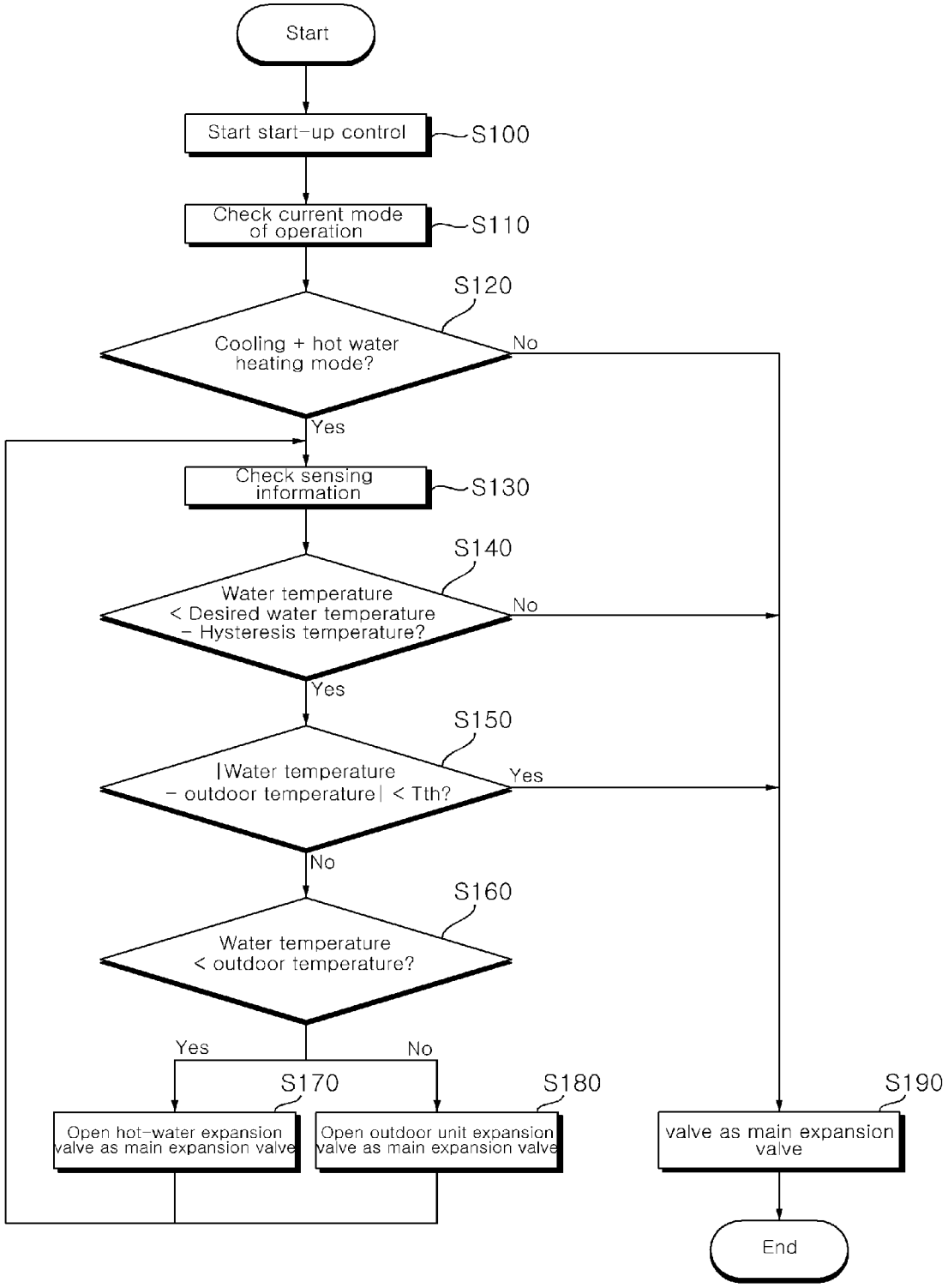
FIG. 14 is a sequential chart for valve control during start-up control of a hot-water heating and cooling operation of the hybrid multi-air conditioning system of FIG. 2 or FIG. 9.
Figure 15:
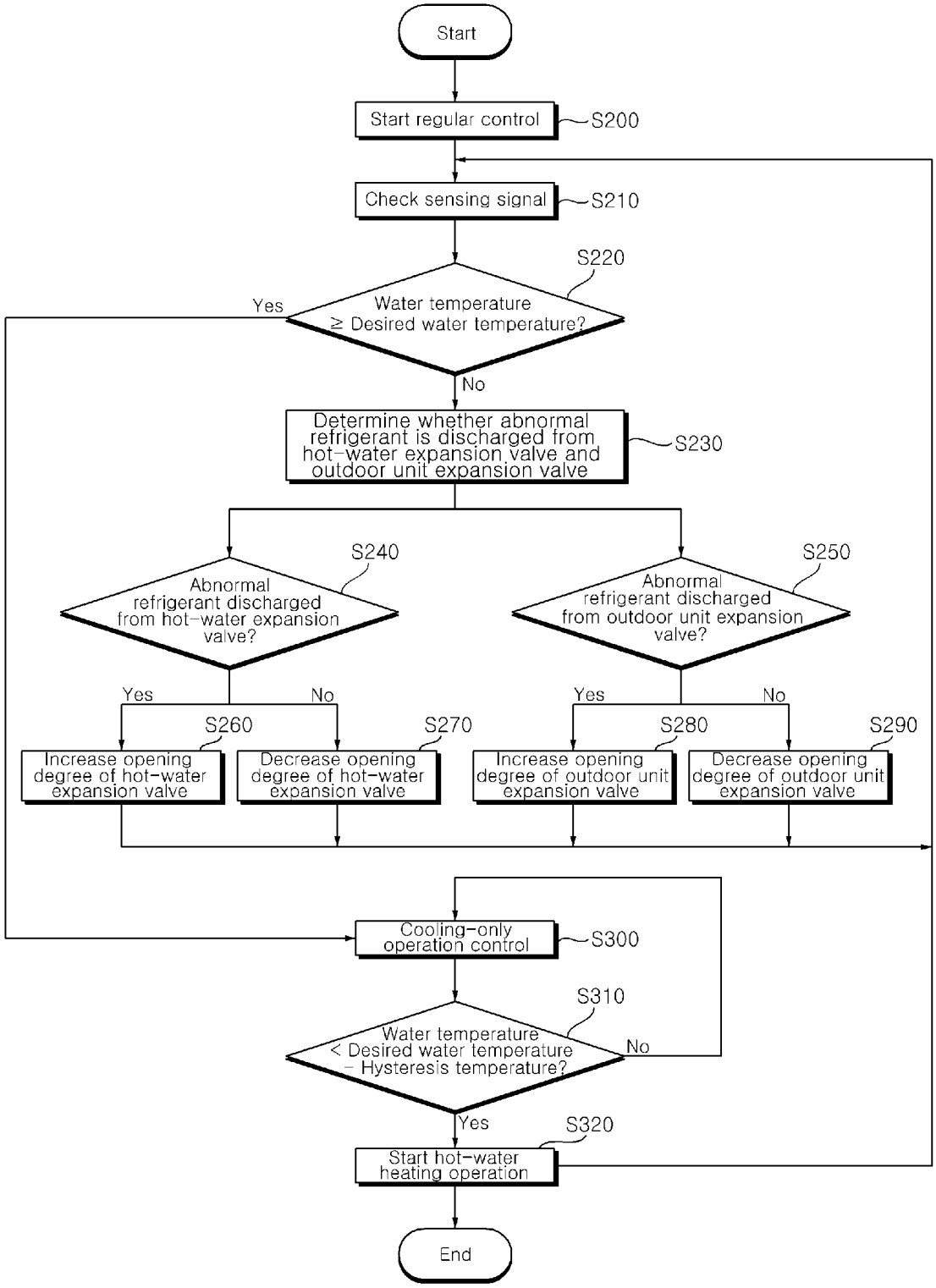
FIG. 15 is a sequential chart for valve control during regular control of the hot-water heating and cooling operation of the hybrid multi-air conditioning system of FIG. 2 or FIG. 9.

FIG. 14 is a sequential chart for valve control during start-up control of a hot-water heating and cooling operation of the hybrid multi-air conditioning system of FIG. 2 or FIG. 9. FIG. 15 is a sequential chart for valve control during regular control of the hot-water heating and cooling operation of the hybrid multi-air conditioning system 100 of FIG. 2 or FIG. 9.

Once the hybrid multi-air conditioning system of FIG. 2 or FIG. 9 starts running, it goes into regular operation after start-up operation.

The start-up operation is defined as a preliminary stage for proceeding to normal refrigerant circulation under an optimal condition by matching a user's operation command and a current status.

As shown in FIG. 14, when the hybrid multi-air conditioning system is turned on and receives a selection signal for an operation mode, start-up control is started (S100).

Once start-up control is started, the controller 18 checks the operation mode selected by the user's input (S110).

If the selected operation mode is a hot-water heating and cooling operation mode, each valve, sensor, and compressor 13 are prepared for operation to operate the hot-water heat exchanger 32 as a condenser, the outdoor heat exchanger 11 as a condenser, and the indoor heat exchanger 21 as an evaporator (S120).

In this case, if the selected operation mode is hot-water heating-only operation, space heating-only operation, or cooling-only operation, the system may enter directly into regular control without start-up control (S190).

If the selected operation mode is a hot-water heating and cooling operation mode, the controller 18 receives temperature sensing information from a plurality of temperature sensors (S130).

The controller 18 reads the water temperature in the water tank 31 of the hot-water unit first and then reads a desired water temperature and a hysteresis temperature which are inputted as settings information.

If the difference between the desired water temperature and the hysteresis temperature is less than a current water temperature, the controller 18 cancels the hot-water heating mode and changes into the cooling-only operation since there is no need to apply heat to the hot-water unit 30.

The change into the cooling-only operation may be performed by shutting off the hot-water valve 15 and opening the outdoor unit valve 16 to allow refrigerant to flow from the compressor 13 to the outdoor heat exchanger 11 alone and then closing the hot-water expansion valve 33 and fully opening the outdoor unit expansion valve 17.

In this case, the indoor unit expansion valve 22 may be opened to the same degree as the opening degree for start-up during the cooling-only operation in the conventional art—for example, around 110 pulses but not limited to this.

In this case, the hysteresis temperature is a hysteresis temperature of the coil of the hot-water heat exchanger 32 that surrounds the water tank 31—for example, 5° C. but not limited to this.

Meanwhile, if the current water temperature is less than the difference between the desired water temperature and the hysteresis temperature (S140), it means that a hot-water heating operation is required to operate the hot-water unit 30 as a condenser, and therefore the hot-water heat exchanger 32 of the hot-water unit 30 is operated as a condenser.

At this point, the controller 18 distributes refrigerant according to the current water temperature and the outdoor temperature (S150).

Specifically, if the difference between the current water temperature and the outdoor temperature is less than a reference temperature Tth, the controller 18 determines that the refrigerant is uniformly distributed through the hot-water unit 30 and the outdoor unit 10, and enters into regular control from the current state (S150).

Meanwhile, if the difference between the current water temperature and the outdoor temperature is greater than or equal to the reference temperature Tth, it is determined that the refrigerant is concentrated on one side, and an operation for uniformly distributing the refrigerant is performed.

Specifically, as shown in FIG. 14, if the water temperature is lower than the outdoor temperature in comparison (S160), it is determined that the liquid refrigerant is concentrated in the hot-water unit 30.

Accordingly, much of the liquid refrigerant concentrated in the water tank 31 is released by fully opening the hot-water expansion valve 33 as a main expansion valve to a maximum degree and opening the outdoor unit expansion valve 17 as a sub expansion valve to a small degree, thereby collecting the concentrated liquid refrigerant and quickly increasing the water temperature (S170).

On the contrary, if the outdoor temperature is lower than the water temperature, the liquid refrigerant concentrated in the outdoor unit 10 is released by fully opening the outdoor unit expansion valve 17 as a main expansion valve to a maximum degree and opening the hot-water expansion valve 33 as a sub expansion valve to a small degree, thereby uniformly distributing the refrigerant (S180).

In uniformly distributing the liquid refrigerant in this manner, both the hot-water valve 15 and the outdoor unit valve 16 are opened so that the refrigerant from the compressor 13 circulates to both condensers.

Moreover, the opening degree at which the hot-water expansion valve 33 is opened as a main expansion valve, the opening degree at which the outdoor unit expansion valve 17 is opened as a main expansion valve, and the opening degree at which each expansion valve 33 and 17 is opened as a sub expansion valve may be different, but are not limited to this.

Such control using the main and sub expansion valves is repeatedly and continuously performed until the difference between the water temperature and the outdoor temperature is less than a reference temperature Tth. When the difference between the water temperature and the outdoor temperature becomes less than the reference temperature Tth, start-up control is finished and the system enters into regular control.

Referring to FIG. 15, once it enters into regular control in a cooling and hot-water heating operation (S200), the controller 18 periodically reads a sensing signal from a plurality of sensors (S210).

If the water temperature is lower than a desired water temperature, the cooling and hot-water heating operation is detected as the current mode, and both the hot-water unit 30 and the outdoor unit 10 are operated as condensers (S220).

That is, the hot-water unit 30 is operated to increase the water temperature up to a desired water temperature, and the indoor unit 20 is operated as an evaporator to cool an indoor space. At this point, the opening degree of the indoor unit expansion valve 22 is controlled by controlling the degree of superheating degree based on a difference between target discharge temperature and current discharge temperature.

In this instance, it is determined whether an abnormal refrigerant is discharged from the hot-water unit 30 and the outdoor unit 10, and the expansion valves 33 and 17 are accordingly controlled (S230).

A description of this can be substituted with the foregoing description.

The hybrid multi-air conditioning system of FIG. 2 according to the one embodiment of the present disclosure and the hybrid multi-air conditioning system of FIG. 9 according to the another embodiment of the present disclosure are capable of periodically determining whether an abnormal refrigerant is discharged or not, according to temperature sensor values.

When it is determined that an abnormal refrigerant is discharged from the hot-water expansion valve 33 and the outdoor unit expansion valve 17, the opening degrees of the expansion valves 33 and 17 are increased until the abnormal refrigerant does not enter the indoor unit expansion valve 22, thereby diminishing the entry of the abnormal refrigerant.

Specifically, when an abnormal refrigerant is discharged from the hot-water expansion valve 33 (S240), the opening degree of the hot-water expansion valve 33 is increased, and, when no abnormal refrigerant is discharged, the opening degree of the hot-water expansion valve 33 is decreased to a minimum to perform subcooling degree control (S270).

Meanwhile, when an abnormal refrigerant is discharged from the outdoor unit expansion valve 17 (S250), the opening degree of the outdoor unit expansion valve 17 is increased (S280), and, when no abnormal refrigerant is discharged, the opening degree of the outdoor unit expansion valve 17 is decreased to a minimum to perform subcooling degree control (S290).

Meanwhile, when the water temperature reaches a desired water temperature, it is determined that no hot-water heating operation is required, and a cooling-only operation is performed (S300).

Specifically, the hot-water valve 15 is shut off, and the hot-water expansion valve 33 also is closed to shut off refrigerant circulation to the hot-water unit 30.

In this instance, the differences among the water temperature, the desired water temperature, and the hysteresis temperature are periodically compared in the cooling-only operation in order to prevent frequent ons and offs of the valves 15 and 33 (S310). The hot-water heating operation is resumed only when the water temperature is lowered by an amount smaller than the difference between the desired water temperature and the hysteresis temperature (S320).

In this case, when switching to a cooling and hot-water heating operation, the hot-water expansion valve 33 may be set to an initial opening degree of around 100 pulses, and the hot-water valve 15 may be opened to allow refrigerant to circulate to the hot-water unit 30.

In this way, the system may enter into regular control while the liquid refrigerant concentrated in a plurality of condensers is uniformly distributed, by comparing sensed temperature values from each sensor and set temperature values during start-up control and regular control.

Moreover, during regular control, it is possible to periodically determine whether an abnormal refrigerant is discharged from each condenser and accordingly control the opening degree of the expansion valve of each condenser, thereby minimizing the abnormal refrigerant entering the evaporator and providing efficient subcooling degree control.

By installing temperature sensors and performing valve control in this manner, the multi-air conditioning system 100 provides uniform distribution of refrigerant without a Hybrid Kit and a receiver, thereby preventing instantaneous shutdown or limited control.

Moreover, equipment cost reduction and smaller installation space may be achieved since the Hybrid Kit and the receiver are not required.

Meanwhile, the hybrid multi-air conditioning system 100 may go into regular control operation following start-up control, in the space heating and hot-water heating mode as well.

Figure 16:
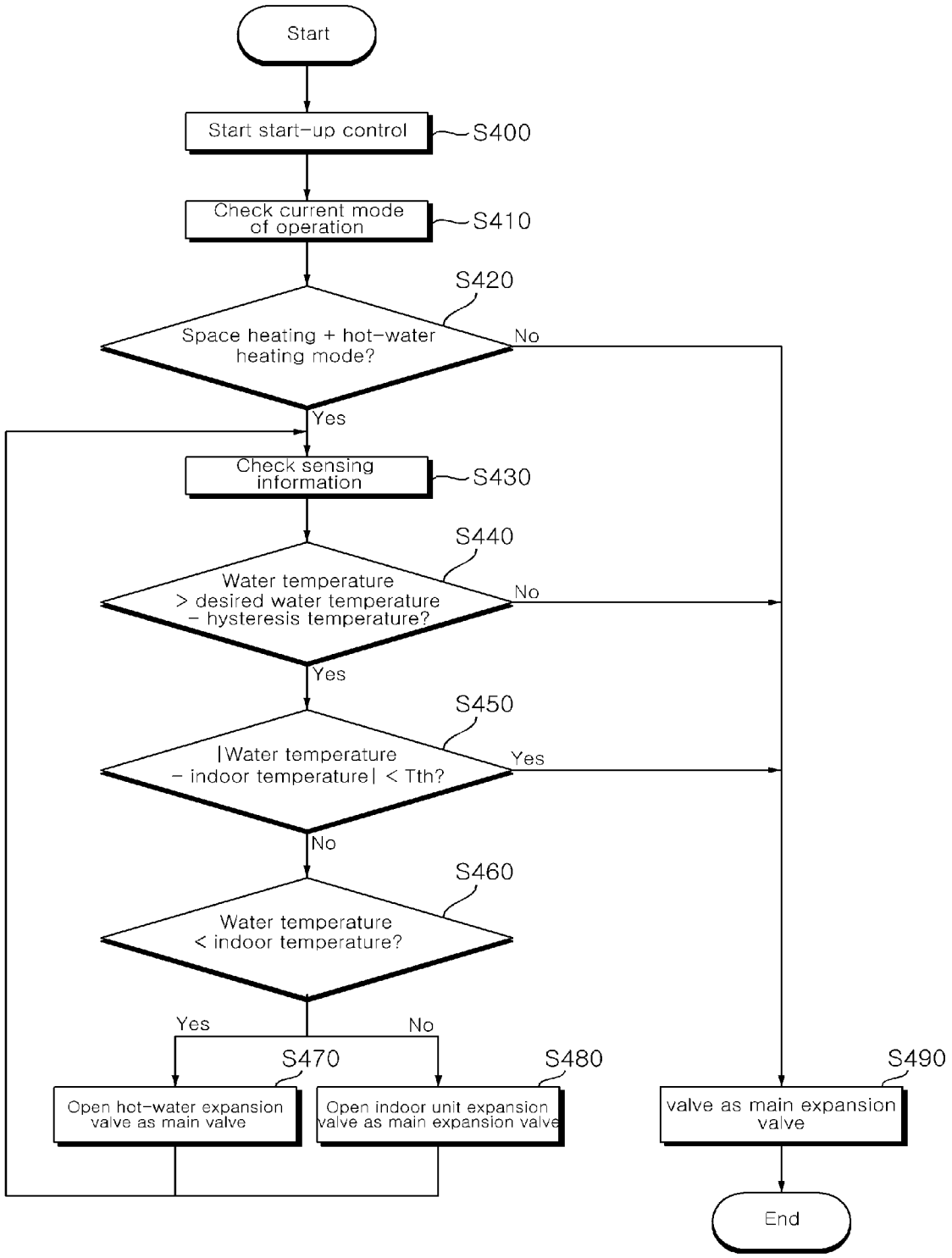
FIG. 16 is a sequential chart for valve control during start-up control of a hot-water heating and space heating operation of the hybrid multi-air conditioning system of FIG. 2 or FIG. 9.
Figure 17:
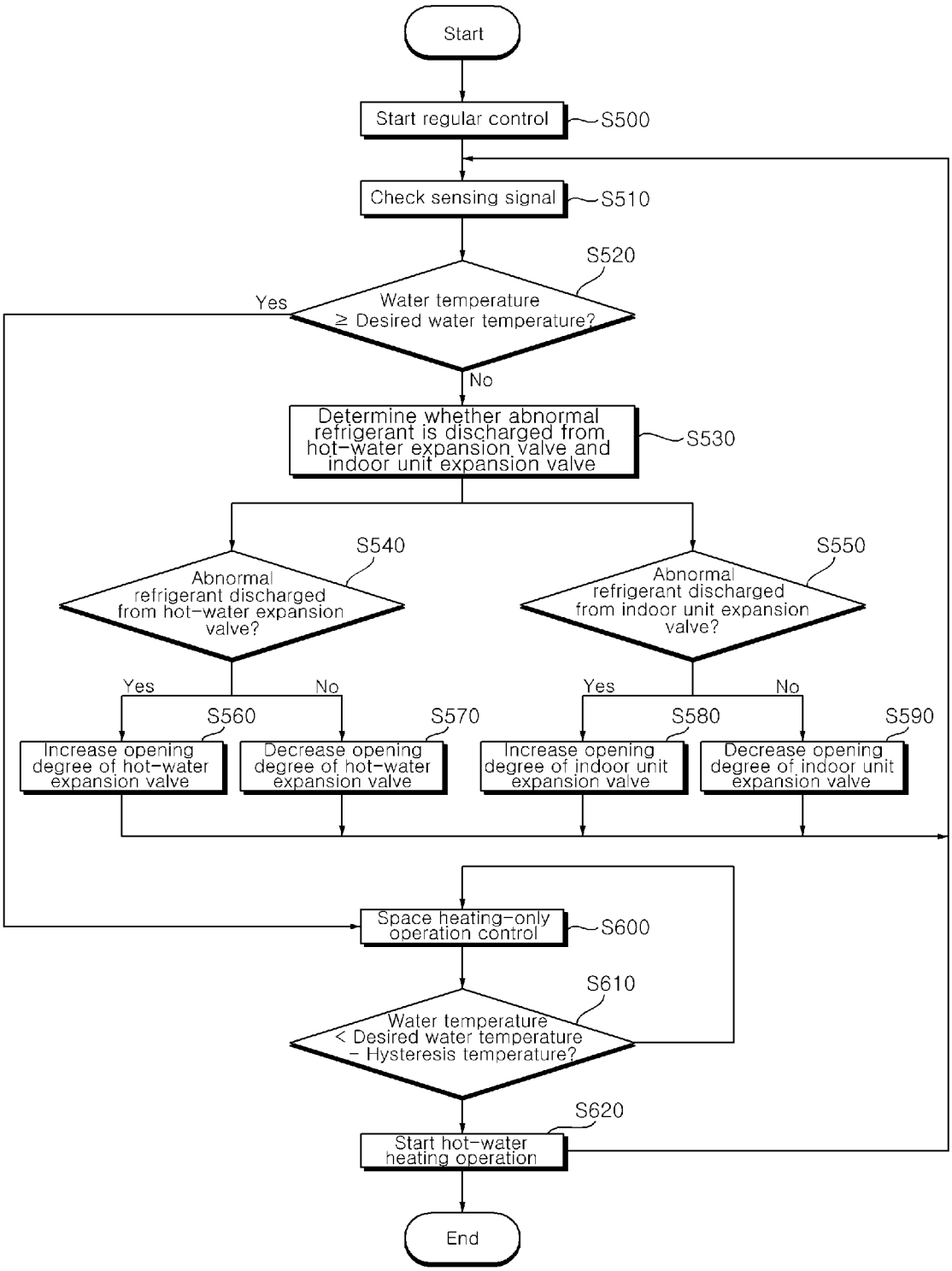
FIG. 17 is a sequential chart for valve control during regular control of the hot-water heating and space heating operation of the hybrid multi-air conditioning system of FIG. 2 or FIG. 9.

FIG. 16 is a sequential chart for valve control during start-up control of a hot-water heating and space heating operation of the hybrid multi-air conditioning system of FIG. 2 or FIG. 9. FIG. 17 is a sequential chart for valve control during regular control of the hot-water heating and space heating operation of the hybrid multi-air conditioning system of FIG. 2 or FIG. 9.

The start-up control is defined as a preliminary stage for proceeding to regular control for normal refrigerant circulation under an optimal condition by matching a user's operation command and a current status.

As shown in FIG. 16, when the hybrid multi-air conditioning system is turned on and receives a selection signal for an operation mode, start-up control is started (S400).

Once start-up control is started, the controller 18 checks the operation mode selected by the user's input (S410).

If the selected operation mode is a hot-water heating and space heating operation mode, each valve, sensor, and compressor 13 are prepared for operation to operate the hot-water heat exchanger 32 as a condenser, the indoor heat exchanger 21 as a condenser, and the outdoor heat exchanger 11 as an evaporator.

In this case, if the selected operation mode is hot-water heating-only operation, space heating-only operation, or cooling-only operation, the system may enter directly into regular control without start-up control (S490).

If the selected operation mode is a hot-water heating and space heating operation mode (S420), the controller 18 receives temperature sensing information from a plurality of temperature sensors (S430).

The controller 18 reads the water temperature in the water tank 31 of the hot-water unit first and then reads a desired water temperature and a hysteresis temperature which are inputted as settings information.

If the difference between the desired water temperature and the hysteresis temperature is less than a current water temperature, the controller 18 cancels the hot-water heating mode and changes into the space heating-only operation since there is no need to apply heat to the hot-water unit 30 (S440).

The change into the space heating-only operation may be performed by shutting off the hot-water valve 15 and opening the outdoor unit valve 16 to allow refrigerant to flow from the compressor 13 to the outdoor heat exchanger 11 alone and then closing the hot-water expansion valve 33 and fully opening the outdoor unit expansion valve 17.

In this case, the indoor unit expansion valve 22 may be opened to the same degree as the opening degree for start-up during the space heating-only operation in the conventional art—for example, around 110 pulses but not limited to this.

In this case, the hysteresis temperature is a hysteresis temperature of the coil of the hot-water heat exchanger 32 that surrounds the water tank 31—for example, 5° C. but not limited to this.

Meanwhile, if the current water temperature is less than the difference between the desired water temperature and the hysteresis temperature, it means that a hot-water heating operation is required to operate the hot-water unit 30 as a condenser, and therefore the hot-water heat exchanger 32 of the hot-water unit 30 is operated as a condenser.

At this point, the controller 18 distributes refrigerant according to the current water temperature and the indoor temperature (S450).

Specifically, if the difference between the current water temperature and the indoor temperature is less than a reference temperature Tth, the controller 18 determines that the refrigerant is uniformly distributed through the hot-water unit 30 and the indoor unit 20, and enters into regular control from the current state.

Meanwhile, if the difference between the current water temperature and the indoor temperature is greater than or equal to the reference temperature Tth, it is determined that the refrigerant is concentrated on one side, and an operation for uniformly distributing the refrigerant is performed.

Specifically, as shown in FIG. 16, if the water temperature is lower than the indoor temperature in comparison, it is determined that the liquid refrigerant is concentrated in the hot-water unit 30 (S470).

Accordingly, much of the liquid refrigerant concentrated in the water tank 31 is released by opening the hot-water expansion valve 33 as a main expansion valve to a maximum degree and opening the indoor unit expansion valve 22 as a sub expansion valve to a small degree, thereby collecting the concentrated liquid refrigerant and quickly increasing the water temperature (S470).

On the contrary, if the indoor temperature is lower than the water temperature, the liquid refrigerant concentrated in the indoor unit is released by opening the indoor unit expansion valve 22 as a main expansion valve to a maximum degree and opening the hot-water expansion valve 33 as a sub expansion valve to a small degree, thereby uniformly distributing the refrigerant (S480).

In uniformly distributing the liquid refrigerant in this manner, both the hot-water valve 15 and the outdoor unit valve 16 are opened so that the refrigerant from the compressor 13 circulates through the entire unit.

Such control using the main and sub expansion valves is repeatedly and continuously performed until the difference between the water temperature and the indoor temperature is less than a reference temperature. When the difference between the water temperature and the indoor temperature becomes less than the reference temperature, start-up control is finished and the system enters into regular control.

Referring to FIG. 17, once it enters into regular control in a space heating and hot-water heating operation (S500), the controller 18 periodically reads a sensing signal from a plurality of sensors (S510).

If the water temperature is lower than a desired water temperature (S520), the space heating and hot-water heating operation is detected as the current mode, and both the hot-water unit 30 and the indoor unit 20 are operated as condensers.

That is, the hot-water unit 30 is operated to increase the water temperature up to a desired water temperature, and the outdoor unit 10 is operated as an evaporator to heat an indoor space. At this point, the opening degree of the outdoor unit expansion valve 17 is controlled by controlling the degree of superheating based on a difference between target discharge temperature and current discharge temperature.

In this instance, it is determined whether an abnormal refrigerant is discharged from the hot-water unit 30 and the indoor unit 20, and the valves are accordingly controlled (S530).

A description of this can be substituted with the foregoing description.

The hybrid multi-air conditioning system of FIG. 2 according to the one embodiment of the present disclosure and the hybrid multi-air conditioning system of FIG. 9 according to the another embodiment of the present disclosure are capable of periodically determining whether an abnormal refrigerant is discharged or not, according to temperature sensor values.

When it is determined that an abnormal refrigerant is discharged from the hot-water expansion valve 33 and the indoor unit expansion valve 22, the opening degrees of the expansion valves are increased until the abnormal refrigerant does not enter the outdoor unit expansion valve 17, thereby diminishing the entry of the abnormal refrigerant.

Specifically, when an abnormal refrigerant is discharged from the hot-water expansion valve 33 (S540), the opening degree of the hot-water expansion valve 33 is increased (S560), and, when no abnormal refrigerant is discharged, the opening degree of the hot-water expansion valve 33 is decreased to a minimum to perform subcooling degree control (S570).

Meanwhile, when an abnormal refrigerant is discharged from the indoor unit expansion valve 22 (S550), the opening degree of the indoor unit expansion valve 22 is increased (S580), and, when no abnormal refrigerant is discharged, the opening degree of the indoor unit expansion valve 22 is decreased to a minimum to perform subcooling degree control (S590). Meanwhile, when the water temperature reaches a desired water temperature, it is determined that no hot-water heating operation is required, and a space heating-only operation is performed (S600).

Specifically, the hot-water valve 15 is shut off, and the hot-water expansion valve 33 also is closed to shut off refrigerant circulation to the hot-water unit 30.

In this instance, the differences among the water temperature, the desired water temperature, and the hysteresis temperature are periodically compared in the space heating-only operation in order to prevent frequent ons and offs of the valves 15 and 33. The hot-water heating operation is resumed only when the water temperature is lowered by an amount smaller than the difference between the desired water temperature and the hysteresis temperature (S610).

In this case, when switching to a space heating and hot-water heating operation, the hot-water expansion valve 33 may be set to an initial opening degree of around 100 pulses, and the hot-water valve 15 may be opened to allow refrigerant to circulate to the hot-water unit 30 (S620).

In this way, the system may enter into regular control while the liquid refrigerant concentrated in a plurality of condensers is uniformly distributed, by comparing sensed temperature values from each sensor and set temperature values during start-up control and regular control.

Moreover, during regular control, it is possible to periodically determine whether an abnormal refrigerant is discharged from each condenser and accordingly control the opening degree of the expansion valve of each condenser, thereby minimizing the abnormal refrigerant entering the evaporator and providing efficient subcooling degree control.

By installing temperature sensors and performing valve control in this manner, the multi-air conditioning system provides uniform distribution of refrigerant without a Hybrid Kit and a receiver, thereby preventing instantaneous shutdown or limited control.

Moreover, equipment cost reduction and smaller installation space may be achieved since the Hybrid Kit and the receiver are not required.

While exemplary embodiments of the disclosure have been shown and described, the present disclosure is not limited to the aforementioned specific embodiments, and it is apparent that various modifications can be made by those having ordinary skill in the art to which the disclosure belongs, without departing from the gist of the disclosure as claimed by the appended claims, and such modifications are not to be interpreted independently from the technical idea or prospect of the disclosure.

Through the above solution, the present disclosure provides a hybrid multi-air conditioning system that improves heat exchange efficiency via direct heat transfer between refrigerant and water by having a coil wound on the water tank to transfer heat between refrigerant and water.

Moreover, it is possible to prevent entry of abnormal refrigerant by controlling the optimal degree of undercooling by regulating the opening degree of the hot-water expansion valve and the opening degree of the expansion valve of the condenser, without installation of a receiver.

Accordingly, material costs and installation costs may be decreased as compared to a model equipped with a receiver, and it is possible to ensure an installation space inside the outdoor unit.

Additionally, it is possible to allow for valve control so as to prevent entry of abnormal refrigerant by installing several temperature sensors at front and rear ends of the expansion valves and controlling the maximum degree of subcooling by comparing temperatures.

Furthermore, the system may be run with optimal efficiency by providing a method for controlling each expansion valve so as to enable hot-water heating and space heating, as well as simultaneous operation of hot-water heating and cooling.

What is claimed is:

1. A hybrid multi-air conditioning system, comprising:

a hot-water unit that exchanges heat between refrigerant and water;

at least one indoor unit installed indoors and comprising an indoor heat exchanger and an indoor unit expansion valve; and an outdoor unit connected to the indoor unit and the hot-water unit via a refrigerant pipeline and comprising an outdoor heat exchanger, a compressor, and an outdoor unit expansion valve, wherein, when an abnormal refrigerant enters either the at least one indoor unit or the outdoor unit according to an operation mode, the abnormal refrigerant is shut off from the hot-water unit and the at least one indoor unit or the outdoor unit which operates as a condenser, wherein the hot-water unit comprises:

a water tank that stores the water;

a hot-water heat exchanger wound on an outer wall of the water tank, that transfers heat between the refrigerant and the water while allowing the refrigerant to flow inside; and a hot-water expansion valve that shuts off the refrigerant condensed by the hot-water heat exchanger or allows the same to flow therethrough, and wherein it is determined whether the abnormal refrigerant is discharged from the hot-water unit based on front and rear end temperatures of the refrigerant passing through the hot-water expansion valve.

2. The hybrid multi-air conditioning system of claimer 1, wherein the hot-water unit comprises:

a first temperature sensor installed at a front end of the hot-water expansion valve; and a second temperature sensor installed at a rear end of the hot-water expansion valve, wherein it is determined whether the abnormal refrigerant is discharged or not based on a temperature difference between the first temperature sensor and the second temperature sensor.

3. The hybrid multi-air conditioning system of claim 2, wherein the outdoor unit comprises:

a third temperature sensor installed at a front end of the outdoor unit expansion valve; and a fourth temperature sensor installed at a rear end of the outdoor unit expansion valve, wherein, when the outdoor unit is operated as a condenser, it is determined whether the abnormal refrigerant is discharged or not based on a temperature difference between the third temperature sensor and the fourth temperature sensor.

4. The hybrid multi-air conditioning system of claim 2, wherein the indoor unit further comprises a fifth temperature sensor at a discharge side of the indoor heat exchanger, wherein, when the outdoor unit is operated as a condenser, it is determined whether the abnormal refrigerant is discharged from the outdoor unit by comparing current and previous temperatures from the fifth temperature sensor.

5. The hybrid multi-air conditioning system of claim 4, wherein, if the abnormal refrigerant is not discharged from the hot-water unit and a difference between the current and previous temperatures from the fifth temperature sensor is greater than a threshold, it is determined that the abnormal refrigerant is discharged from the outdoor unit.

6. The hybrid multi-air conditioning system of claim 2, wherein the hot-water expansion valve is fully opened if the abnormal refrigerant is discharged from the hot-water unit, and the outdoor unit expansion valve is fully opened if the abnormal refrigerant is discharged from the outdoor unit.

7. The hybrid multi-air conditioning system of claim 2, wherein the outdoor unit further comprises:

a hot-water valve that allows a condensed refrigerant to flow from the compressor to the hot-water unit; and an outdoor unit valve that allows the condensed refrigerant to pass through a four-way valve from the compressor and flow to the outdoor heat exchanger or the indoor heat exchanger.

8. The hybrid multi-air conditioning system of claim 2, wherein the water temperature in the water tank and the temperature of the condenser are compared before regular operation to uniformly distribute a liquid refrigerant.

9. The hybrid multi-air conditioning system of claim 8, wherein, if the water temperature is higher than the temperature of the condenser, the hot-water expansion valve is fully opened to uniformly distribute the liquid refrigerant concentrated in the hot-water unit.

10. The hybrid multi-air conditioning system of claim 8, wherein, if the water temperature is lower than the temperature of the condenser, the indoor unit expansion valve or outdoor unit expansion valve of the condenser is fully opened to uniformly distribute the liquid refrigerant concentrated in the condenser.

11. The hybrid multi-air conditioning system of claim 9, wherein, when the liquid refrigerant is uniformly distributed, the hot-water valve and the outdoor unit valve are opened.

12. The hybrid multi-air conditioning system of claim 3, wherein, if the temperature difference between the first temperature sensor and the second temperature sensor is greater than a first threshold, it is determined that the abnormal refrigerant is discharged from the hot-water unit.

13. The hybrid multi-air conditioning system of claim 12, wherein, if the temperature difference between the third temperature sensor and the fourth temperature sensor is greater than a second threshold, it is determined that the abnormal refrigerant is discharged from the outdoor unit.

14. The hybrid multi-air conditioning system of claim 13, wherein the first threshold is equal to the second threshold.

15. The hybrid multi-air conditioning system of claim 13, wherein the hybrid multi-air conditioning system is operated in a hot-water heating and cooling operation mode, a hot-water heating and space heating operation mode, a cooling-only operation mode, a space heating-only operation mode, and a hot-water heating-only operation mode.

16. The hybrid multi-air conditioning system of claim 13, wherein, when the hybrid multi-air conditioning system is in the hot-water heating and space heating operation mode, the outdoor unit operates as an evaporator, the indoor unit operates as a condenser, and it is determined that the abnormal refrigerant enters the outdoor unit.

17. The hybrid multi-air conditioning system of claim 16, wherein the hybrid multi-air conditioning system allows the condensed refrigerant from the hot-water expansion valve to directly enter the indoor unit or the outdoor unit which operates as the evaporator.

18. The hybrid multi-air conditioning system of claim 17, wherein the hot-water heat exchanger is formed as a pipeline wound on an outer wall of the water tank in coil form that allows the refrigerant to flow therethrough.

* * * * *